United States Patent [19]

Shiba et al.

[11] 4,015,988

[45] Apr. 5, 1977

[54] MULTILAYER COLOR PHOTOGRAPHIC LIGHT-SENSITIVE MATERIAL

[75] Inventors: Keisuke Shiba; Takeshi Hirose; Jun Hayashi; Toshiaki Aono, all of Minami-ashigara, Japan

[73] Assignee: Fuji Photo Film Co., Ltd., Minami-ashigara, Japan

[22] Filed: Mar. 4, 1975

[21] Appl. No.: 555,314

[30] Foreign Application Priority Data

Mar. 4, 1974 Japan ..... 49-25482

[52] U.S. Cl. ..... 96/69; 96/74; 96/56; 96/95; 96/100

[51] Int. Cl.[2] ..... G03C 1/76; G03C 7/00; G03C 1/06; G03C 1/40

[58] Field of Search ..... 96/100, 100 N, 3, 9, 96/69, 74, 56, 95

[56] References Cited

UNITED STATES PATENTS

| | | | |
|---|---|---|---|
| 3,311,476 | 3/1967 | Loria | 96/100 |
| 3,364,022 | 1/1968 | Barr | 96/100 |
| 3,617,291 | 11/1971 | Sawdey | 96/100 |
| 3,619,195 | 11/1971 | Van Campen | 96/100 |
| 3,620,745 | 11/1971 | Seymour | 96/100 |
| 3,620,746 | 11/1971 | Barr | 96/3 |
| 3,640,716 | 2/1972 | Nagae | 96/100 |
| 3,770,436 | 11/1973 | Fujiwhara et al. | 96/100 |
| 3,869,291 | 3/1975 | Mäder | 96/100 |

*Primary Examiner*—Mary F. Kelley
*Attorney, Agent, or Firm*—Sughrue, Rothwell, Mion, Zinn & Macpeak

[57] ABSTRACT

A multilayer color photographic light-sensitive material comprising a support having thereon at least two silver halide emulsion layer units, each of which is sensitive to radiation of a substantially different wavelength region within the wavelength region of from about 220 nm to about 800 nm and contains a color-forming coupler capable of forming a dye on coupling with an oxidized primary aromatic amine developing agent, with at least one of the emulsion layer units containing an ICC coupler represented by the general formula (I)

(I)

wherein Cp represents a coupler residue; L and M each represents a nitrogen atom or a methine group, V represents a monocyclic or dicyclic aromatic ring of the benzene series, and at least one of L and M represents a nitrogen atom; which releases a triazole derivative or a diazole derivative on coupling with an oxidized primary aromatic amine developing agent, and with the emulsion layer unit containing the ICC coupler represented by the general formula (I) or another layer containing a hydroquinone derivative represented by the general formula (II)

(II)

wherein A and A′ each represents a hydrogen atom or a group capable of being eliminated by an alkali, and A′ can combine with R to Q to form a ring; P, Q and R each represents a hydrogen atom, an alkyl group, an aryl group, an alkylthio group, an arylthio group, a hydroxy group, a halogen atom, an alkoxy group, an aryloxy group, a heterocyclic ring or an —S—Z group, and P and Q can combine to form a ring; and Z represents a heterocyclic ring residue substantially photographically inert in a bonded state; which releases imagewise depending upon the development a compound having a mercapto group and/or a coupler which releases a compound having a mercapto group on coupling with an oxidized primary aromatic amine developing agent. The multilayer color photographic light-sensitive material provides color images having improved color reproduction, sharpness and graininess.

14 Claims, 3 Drawing Figures

MULTILAYER COLOR PHOTOGRAPHIC LIGHT-SENSITIVE MATERIAL

BACKGROUND OF THE INVENTION

1. Field of the Invention

The present invention relates to a multilayer color photographic light-sensitive material which provides color images having good color purity, sharpness and graininess.

2. Description of the Prior Art

It is well known that couplers, that is to say, compounds capable of forming dyes such as indophenols, indoanilines, indamines, azomethines, phenoxazines, phenazines, and the like, on coupling with oxidized primary aromatic amine developing agents are used in color photographic materials containing silver halide emulsion layers.

On the other hand, a silver halide color photographic material based on the substractive three primary color principle has, as a layer structure, a silver halide emulsion layer to form a yellow color due to the action of blue light, a silver halide emulsion layer to form a color due to the action of green light, and a silver halide emulsion layer to form a cyan color due to the action of red light. When a color-forming system wherein a primary aromatic amine developing agent and couplers are used is employed in the color image formation of such a color photographic material, an acylacetamide derivative or a dibenzoylmethane derivative is usually used as the yellow-forming coupler, a 5-pyrazolone derivative, a cyanoacetyl derivative, an indazolone derivative, or a pyrazolonebenzimidazole derivative is usually used as the magenta-forming coupler, and a phenol derivative or an $\alpha$-naphthol derivative is usually used as the cyan-forming coupler.

In the multilayer color photographic materials as described above, various characteristics are required in the color images formed.

One characteristic is that when color images are formed in one emulsion layer unit, color images are not formed in other emulsion layer units in order to prevent color mixing. That is to say, images with good color purity is desired.

Another characteristic is that fine details of the color images are clear, that is, the images have good sharpness.

Still another characteristic is that the color images appear to be grainless, that is, the images have good graininess.

A still further characteristic is that images can be reproduced with fidelity over a wide range of exposure amount, that is, a wide exposure latitude.

Various attempts have been made to provide multilayer color photographic light-sensitive materials having these characteristics. However, these attempts have not yet proven to be satisfactory.

For instance, in using a coupler which releases a compound having a mercapto group on coupling with an oxidized primary aromatic amine developing agent as described in U.S. Pat. No. 3,227,554, while the sharpness, graininess and exposure latitude are improved to some extent, no improvement in the color purity is effectively achieved. This defect is particularly marked when a fine grain silver halide emulsion is used.

Also using a development inhibitor releasing hydroquinone derivative represented by the general formula (II) described hereinafter, such as is described, for example, in U.S. Pat. No. 3,379,529, the same is obtained as when the above-described coupler which releases a compound having a mercapto group on coupling with an oxidized primary aromatic amine developing agent is used.

Further when a two-equivalent coupler is used, the thickness of the emulsion layer can be reduced resulting in an improvement in the sharpness. However, the color purity and graininess rather tend to decrease.

Furthermore, in using an interlayer color correction coupler (hereinafter designated as an "ICC coupler") such as is described, for example, in U.S. Pat. application Ser. Nos. 454,525, filed Mar. 25, 1974 and 467,539, filed May 6, 1974, while the color purity is improved due to color correction effects due to the so-called interlayer effects and the sharpness is improved due to edge effects, the graininess is not sufficiently improved.

The term "ICC coupler" as used herein means a coupler as defined in U.S. Pat. application Ser. No. 467,539, filed May 6, 1974 and means a coupler which exhibits interlayer effects together with less development inhibiting effects in the developing layer when such a coupler is used in a multilayer photographic light-sensitive material and as the result has a "color correction function." The term "interlayer effects" means development inhibiting effects in one or more of the other layers depending on the development of one layer of a multilayer material. One method to achieve these effects is to use development inhibitors which are released imagewise depending on the development in one emulsion layer and are diffused to one or more other layers. The "development inhibiting effects" in the developing layer are those which reduce the gradation of an emulsion layer in which the compound is incorporated.

SUMMARY OF THE INVENTION

An object of the present invention is to provide a multilayer color photographic light-sensitive material which simultaneously satisfies the above-described characteristics required for multilayer color photographic light-sensitive materials.

Another object of the present invention is to provide a multilayer color photographic light-sensitive material which satisfies the above-described characteristics and can be suitably subjected to rapid processing at an elevated temperature.

Still another object of the present invention is to provide an image-forming method to obtain color images having good sharpness, graininess and color purity by development of the above-described multilayer color photographic light-sensitive material.

These and other objects of the present invention will become apparent from the following detailed description of the present invention.

These objects of the present invention are accomplished with the multilayer color photographic light-sensitive material according to the present invention. That is, the multilayer color photographic light-sensitive material of this invention comprises a support having thereon at least two silver halide emulsion layer units, each of which is sensitive to radiation in a substantially different wavelength region within the wavelength region of from about 220 nm to about 800 nm and which contains a color forming coupler capable of forming a dye on coupling with an oxidized primary aromatic amine developing agent, with at least one of the emulsion layer units containing an ICC coupler represented by the general formula (I)

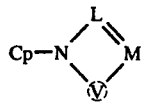

(I)

wherein Cp represents a coupler residue; L and M each represents a nitrogen atom or a methine group, V represents a monocyclic or dicyclic aromatic ring of the benzene series, and at least one of L and M represents a nitrogen atom; which releases a triazole derivative or a diazole derivative on coupling with an oxidized primary aromatic amine developing agent, and with the emulsion layer unit containing the ICC coupler represented by the general formula (I) or another layer containing a hydroquinone derivative represented by the general formula (II)

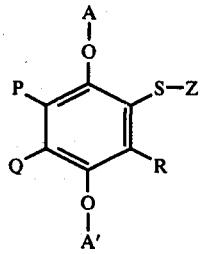

(II)

wherein A and A′ each represents a hydrogen atom or a group capable of being eliminated by an alkali, and A′ can combine with R or Q to form a ring; P, Q and R each represents a hydrogen atom, an alkyl group, an aryl group, an alkylthio group, an arylthio group, a hydroxy group, a halogen atom, an alkoxy group, an aryloxy group, a heterocyclic ring or an —S—Z group, and P and Q can combine to form a ring; and Z represents a heterocyclic ring residue substantially photographically inert in a bonded state; which releases imagewise depending upon development a compound having a mercapto group and/or a coupler which releases a compound having a mercapto group on coupling with an oxidized primary aromatic amine developing agent.

DETAILED DESCRIPTION OF THE INVENTION

In the general formula (I)

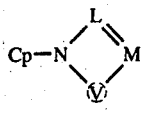

(I)

Figure 1:
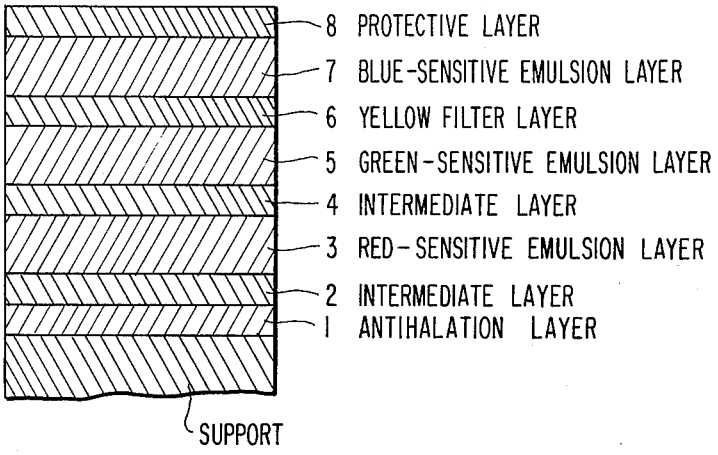
FIG. 1, FIG. 2 and FIG. 3 each represents schematically the layer structure of the photographic light-sensitive material which is used in Examples 1 to 3, respectively.

Cp represents a coupler residue which reacts to couple with an oxidized primary aromatic amine developing agent, L and M each represents a nitrogen atom, a methine group or a substituted methine group (for example, a methine group substituted with a lower alkyl group (e.g., having 1 to 4 carbon atoms such as a methyl group, an ethyl group, a propyl group, a butyl group, etc.), a halogen atom (e.g., a chlorine atom, a bromine atom, etc.), etc.), V represents a monocyclic or dicyclic aromatic ring of the benzene series (e.g., a phenyl ring, a naphthyl ring, etc.), and the aromatic ring of the benzene series represented by V can be substituted with a halogen atom, for example, a chlorine atom, a bromine atom, a fluorine atom, etc., or a group having up to about 15 carbon atoms, for example, a nitro group, a cyano group, a thiocyano group, a hydroxy group, an alkoxy group, an aryloxy group, an acyloxy group, an alkyl group, an alkenyl group, an aryl group, an amino group, a carboxy group, an acyl group, an alkoxycarbonyl group, an aryloxycarbonyl group, a carbamoyl group, an acylamino group, an imido group, an imino group, a sulfo group, an alkylsulfonyl group, an arylsulfonyl group, an alkoxysulfonyl group, an aryloxysulfonyl group, a sulfamoyl group, a sulfonamido group, a ureido group, a thioureido group, a heterocyclic group, etc., and the like, and at least one of L and M represents a nitrogen atom.

Cp is a coupler residue and can be selected, for example, from residues of 4-equivalent couplers which are used in color photographic light-sensitive materials. Examples of suitable residues are residues of 5-pyrazolone couplers, cyanoacetyl chroman couplers, indazolone couplers, open-chain ketomethylene type couplers (for example, acylacetanilide couplers, pivaloyl acetanilide couplers, aroylacetamide couplers, cyanoacetyl couplers, etc.), naphthol couplers, phenol couplers, and the like. Suitable examples of couplers from which the coupler residue represented by Cp is derived include these described in U.S. Pat. Nos. 2,728,658, 2,875,057, 2,908,573, 3,046,129, 3,227,155, 3,227,550, 3,227,554, 3,253,924, 3,265,506, 3,369,895, 3,408,194, 3,415,652, 3,582,322, 2,600,788, 2,801,171, 2,983,608, 3,062,653, 3,311,476, 3,419,391, 3,468,666, 3,558,319, 2,369,929, 2,423,730, 2,474,293, 2,521,908, 3,622,328, 2,632,345, 2,895,826, 2,419,390, 3,476,563, 3,591,383, and 3,458,315.

As the hydroquinone derivative capable of releasing a compound having a mercapto group depending on development which can be used in the present invention, those hydroquinone derivatives as described in U.S. Pat. application Ser. No. 461,087, filed Apr. 15, 1974, U.S. Pat. Nos. 3,379,529 and 3,639,417 and the like are specifically illustrated. Preferred hydroquinone derivatives are represented by the following general formula (II)

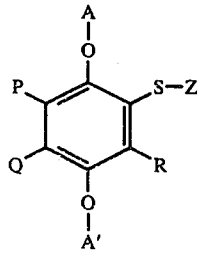

(II)

wherein A and A′ each represents a hydrogen atom or a group capable of being eliminated by an alkali (e.g., an alkoxycarbonyl group, an acyl group, etc., e.g., having 2 to about 10 carbon atoms such as an acetyl group, a propionyl group, a methoxycarbonyl group, a phenoxycarbonyl group, etc.), and A′ can combine with R or Q to form a ring (e.g., an oxathiazole ring, an oxazole ring, an oxadiazole ring, a furyl ring, etc.); P, Q or R each represents a hydrogen atom, an alkyl group (e.g., having 1 to 20 carbon atoms such as a methyl group, an ethyl group, a 1,1,3,3-tetramethylbutyl group, an n-pentadecyl group, etc.), an aryl group (e.g., a phenyl group, or a substituted phenyl group in which the phenyl group contains one or more of an alkyl group having 1 to 10 carbon atoms, e.g., a methyl group, an ethyl group, a butyl group, an octyl group, etc.; an alkoxy group having 1 to 10 carbon atoms, e.g., a methoxy group, a butoxy group, an octoxy group, etc.; an amide group having 2 to 10 carbon atoms, e.g., an acetamido group, a butyramido group, etc.; a halogen atom, e.g., a chlorine atom, a bromine atom, a fluorine atom, or an iodine atom, etc., as a substituent, etc.), an —S—Y residue (wherein Y is an alkyl group (e.g., having 1 to 20 carbon atoms such as a 2-ethylhexyl group, an n-dodecyl group, an n-hexadecyl group, an n-octadecyl group, a hydroxycarbonylmethyl group, an ethoxycarbonylmethyl group, a 2-hydroxyethyl group, etc.), or an aryl group (e.g., a phenyl group, or a substituted phenyl group in which the phenyl group contains one or more of an alkyl group having 1 to 10 carbon atoms, e.g., a methyl group, an ethyl group, a butyl group, an octyl group, etc.; an alkoxy group having 1 to 10 carbon atoms, e.g., a methoxy group, a butoxy group, an octoxy group, etc.; an amide group having 2 to 10 carbon atoms, e.g., an acetamido group, a butyramido group, etc.; a halogen atom, e.g., a chlorine atom, a bromine atom, a fluorine atom, or an iodine atom, etc.; as a substituent )), a hydroxy group, a halogen atom, e.g., a chlorine atom, a bromine atom, a fluorine atom, etc., an —S—Z residue, an —O—Y residue (where Y is as defined above), or a heterocyclic ring (e.g., a tetrazolyl ring, a thiazolyl ring, a quinolinyl ring, etc.); Z represents a heterocyclic ring residue substantially photographically inert in a bonded state and, particularly, Z represents a tetrazolyl group (e.g., a 1-phenyltetrazolyl group, etc.), a triazolyl group (e.g., a 4-phenyl-1,2,4-triazol-5-yl group, a 3-n-pentyl-4-phenyl-1,2,4-triazol-5-yl group, etc.), a thiadiazolyl group (e.g., a 2-methylthio-1,3,4-thiadiazol-5-yl group, a 2-amino-1,3,4-thiadiazol-5-yl group, etc.), an oxadiazolyl group (e.g., a 2-phenyl-1,3,4-oxadiazol-5-yl group, etc.), a tetraazaindenyl group (e.g., a 6-methyl-1,3,3*a*,7-tetraazainden-4-yl group, a 6-n-nonyl-1,3,3*a*,7-tetraazainden-4-yl group, etc.), an oxazolyl group (e.g., a benzoxazol-2-yl group, etc.), a thiazolyl group (e.g., a benzothiazol-2-yl group, etc.), or the like. In particular, of P, Q and R, R can be an —S—Z residue. The chemical structure of the molecule contains a ballasting group, and preferably the chemical structure of P, Q or R contains such a ballasting group.

Suitable couplers which release a compound having a mercapto group on coupling with an oxidized primary aromatic amine developing agent which are used in the present invention are those couplers as described in U.S. Pat. No. 3,227,554 and the like. Preferred mercapto group releasing coupler compounds are represented by the following general formula (III)

$$Cp - S - Z \qquad \text{(III)}$$

wherein Cp has the same meaning as defined in the general formula (I), and Z has the same meaning as defined in the general formula (II).

In the present specification, the term "emulsion layer unit" means a group of one or more emulsion layers which are sensitive to radiation within substantially the same wavelength region. When the unit contains two or more emulsion layers, these emulsion layers can be positioned in contact with each other or separated by an emulsion layer of another unit, an intermediate layer of a layer for another specific purpose.

The couplers represented by the general formula (I) which can be used in the photographic light-sensitive material of the present invention are the so-called ICC couplers and those described, for example, in U.S. Pat. application Ser. No. 454,525, filed Mar. 25, 1974, are particularly preferred. Also those described in U.S. Pat. Nos. 3,617,291 and 3,770,436 can be used. When such a coupler is used in a multilayer color photographic light-sensitive material, improvements in color purity depending on color correction effects based on interlayer effects and sharpness based on edge effects are achieved. However, the improvement in graininess is not sufficient. It is believed that this fact is based on the properties of the triazole or diazole compound which is released upon coupling of the coupler represented by the general formula (I) with an oxidized primary aromatic amine developing agent and which acts as a development inhibitor.

The hydroquinone compound represented by the general formula (II) which releases a compound having a mercapto group depending on development, which is another element used in the photographic light-sensitive material of the present invention, includes those hydroquinones described in U.S. Pat. No. 3,379,529 and U.S. application Ser. No. 494,955, filed Aug. 5, 1974. When such a hydroquinone compound is used in a multilayer color photographic light-sensitive material, improvements in sharpness based on edge effects and graininess are achieved, however, due to insufficient interlayer effects the improvement in color purity is not satisfactory. The defect of the compound is particularly marked when the compound is used in a photographic light-sensitive material containing a fine grain silver halide emulsion. Also, when the compound is used in a larger amount in order to further improve the sharpness and graininess, the development in the layer is extremely restrained resulting in the disadvantage of a decrease in color density occurring. It is believed that this fact is based on the properties of the monothio compound which is released from the hydroquinone compound depending upon development and which acts as a development inhibitor.

The coupler represented by the general formula (III) which is the other element and can be used together with the coupler represented by the general formula (I) in the photographic light-sensitive material of the present invention includes those couplers described, for example, in U.S. Pat. Nos. 3,227,554 and 3,615,506, and Japanese Pat. application Nos. 128984/73 and 128985/73. The coupler releases a monothio compound which acts as a development inhibitor upon coupling with an oxidized primary aromatic amine developing agent, and a multilayer color photographic light-sensitive material containing such a coupler has the same advantages and defects as described in the photographic light-sensitive material containing the above-described compound (II).

On the contrary, the multilayer color photographic light-sensitive material of the present invention containing the coupler of the general formula (I) together with the hydroquinone of the general formula (II) and/or the coupler of the general formula (III) does not have the defects which are exhibited in a multilayer color photographic light-sensitive material containing each of the compounds individually, as described above, and provides color images of extremely superior image qualities in color purity, sharpness and graininess due to the interaction of the advantages of each compound. Also, by using the compound of the general formula (I) together with the compound of the general formula (II) or (III), a photographic light-sensitive material having an appropriate gradation and a wide exposure latitude results. The superior characteristics of the photographic light-sensitive material of the present invention would not have been expected from a consideration of the effects achieved when the compound of the general formula (I), (II) or (III) is used individually, and these superior characteristics can firstly be found when embodiments of the present invention are practiced.

According to a preferred embodiment which achieves the objects of the present invention, a multilayer color photographic light-sensitive material is provided which comprises a support having thereon at least two silver halide emulsion layer units each of which is sensitive to radiation of a substantially different wavelength region within the wavelength region of from about 220 nm to about 800 nm, at least one of the emulsion layer units comprising two or more silver halide emulsion layers, at least one of the silver halide emulsion layers containing an ICC coupler, and at least one of the emulsion layer units containing a hydroquinone derivative represented by the general formula (II) and/or a coupler which releases a compound haing a mercapto group on coupling with an oxidized primary aromatic amine developing agent.

By separating at least one of the emulsion layer units into two or more silver halide emulsion layers as described above, it is possible to combine the effects of the ICC coupler and the effects of the hydroquinone represented by the general formula (II) and/or the coupler which releases a compound having a mercapto group on coupling with an oxidized primary aromatic amine developing agent and thus to easily obtain even further superior color purity, graininess and sharpness as well as high optical density and wide latitude.

Also, the photographic light-sensitive material according to the present invention in which at least one of the emulsion layer units or at least one of the emulsion layers which constitutes an emulsion layer unit is a fine grain silver halide emulsion layer containing silver halide grains having an average grain size of about 0.01 to 0.5 microns is preferred. Heretofore, it has been difficult to obtain an improvement in color purity by using a coupler which releases a compound having a mercapto group on coupling with an oxidized aromatic amine developing agent in a fine grain silver halide emulsion layer. On the contrary, in accordance with the present invention, a fine grain silver halide emulsion layer is preferably used to effectively achieve the objects of the present invention.

Further, preferably the color photographic light-sensitive material of the present invention contains an adsorbing layer for a development inhibitor (ADL) positioned above the emulsion layer farthest from the support (i.e., the outermost emulsion layer). An adsorbing layer for a development inhibitor is a layer for adsorbing and fixing a development inhibitor and is specifically described in U.S. Pat. application Ser. No. 513,670, filed Oct. 9, 1974, U.S. Pat. No. 3,984,245 (corresponding to Japanese Pat. application No. 113,633/73), U.S. Pat. No. 3,737,317, German Pat. application OLS No. 2,322,165, etc.

By the use of such an adsorbing layer for a development inhibitor, it is possible to use the ICC coupler, the hydroquinone derivative and/or the coupler which releases a compound having a mercapto group on coupling with an oxidized primary aromatic amine developing agent in a larger amount resulting in a further increase in the effects of the present invention.

One embodiment of the present invention is a multilayer color photographic light-sensitive material which comprises a support having thereon a blue-sensitive emulsion layer unit comprising at least one silver halide emulsion layer which is substantially sensitive to blue radiaion (i.e., having a wavelength shorter than about radiation 500 nm) and contains a yellow color coupler capable of forming a yellow dye upon coupling with an oxidized primary aromatic amine developing agent, a green-sensitive emulsion layer unit comprising at least one silver halide emulsion layer which is substantially sensitive to green radiation (i.e., having a wavelength from about 500 nm to about 600 nm), and contains a magenta color coupler capable of forming a magenta dye upon coupling with an oxidized primary aromatic amine developing agent, and a red-sensitive emulsion layer unit comprising at least one silver halide emulsion layer which is substantially sensitive to red radiation (i.e., having a wavelength longer than about 600 nm) and contains a cyan color coupler capable of forming a cyan dye upon coupling with an oxidized primary aromatic amine developing agent, and at least one of the emulsion layers containing a coupler of the general formula (I) and a hydroquinone of the general formula (II) and/or a coupler of the general formula (III).

Another embodiment of the present invention is a multilayer color photographic light-sensitive material comprising a support having thereon a blue-sensitive emulsion layer unit, a green-sensitive emulsion layer unit and a red-sensitive emulsion layer unit, and at least one of the emulsion layers containing a coupler of the general formula (I) and at least one of the other emulsion layers containing a hydroquinone of the general formula (II) and/or a coupler of the general formula (III).

In the above-described two embodiments, the emulsion layers which comprise the blue-sensitive emulsion layer unit, the green-sensitive emulsion layer unit and the red-sensitive emulsion layer unit can be positioned in various orders depending on the end-use of the photograhic light-sensitive material. For instance, when each emulsion layer unit comprises one emulsion layer, the red-sensitive emulsion layer, the green-sensitive emulsion layer, and the blue-sensitive emulsion layer are positioned in this order on the support. The order of the emulsion layers can also be altered to other layer orders. Further, when the emulsion layer unit comprises two or more emulsion layers, these layers can be positioned adjacent each other or separated by an emulsion layer of another emulsion layer unit.

A multilayer color negative photographic light-sensitive material which comprises a support having thereon a red-sensitive silver halide emulsion layer unit containing a non-diffusible uncolored cyan coupler and a non-diffusible colored cyan coupler both of which provide a cyan image on color development, a green-sensitive silver halide emulsion layer unit containing a non-diffusible uncolored magenta coupler and a non-diffusible colored magenta coupler both of which provide a magenta image on color development, a blue-sensitive silver halide emulsion layer unit containing a non-diffusible uncolored yellow coupler which provides a yellow image on color development, with at least one of the red-sensitive emulsion layer unit, the green-sensitive emulsion layer unit and the blue-sensitive emulsion layer unit containing an ICC coupler and the emulsion layer unit containing the ICC coupler or another emulsion layer unit containing a hydroquinone derivative represented by the general formula (II) and/or a coupler which releases a compound having a mercapto group on coupling with an oxidized primary aromatic amine developing agent is particularly useful.

The effects of the present invention are particularly recognized when a colored coupler is used together with an uncolored coupler. In particular, the practical value of the present invention specifically appears in the color negative as described above.

The multilayer color photographic light-sensitive material of the present invention can have, together with the emulsion layers which comprise the above-described emulsion layer units, an anti-halation layer, an anti-irradiation layer, a light-filter layer, a layer for preventing color mixing, protective layer, an ADL layer as described in U.S. Pat. application Ser. No. 513,670, filed Oct. 9, 1974, U.S. Pat. No. 3,984,245 (corresponding to Japanese Pat. application No. 113,633/73) and the like, if desired. These layers can be placed in any desired position, either below or above (in relation to the incident light of exposure) the above-described photographic light-sensitive emulsion layers.

In the multilayer color photographic light-sensitive material according to the present invention, any of the compounds represented by the general formulas (II) and (III) can be used. When the compound represented by the general formula (III) is used, it is necessary to select a suitable compound by taking the color hue of the dye which is formed from the compound upon coupling with a color developing agent into consideration. On the other hand, the compound of the general formula (II) does not have such a limitation and can be advantageously used, since the compound does not form a dye on color development.

Of the couplers represented by the general formula (I) used in the multilayer color photographic light-sensitive material of the present invention, those represented by the following general formula (IV) are particularly useful:

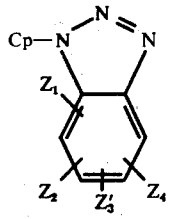

(IV)

wherein Cp has the same meaning as defined in the general formula (I); $Z_1$ to $Z_4$, which can be the same or different, each represents a hydrogen atom, a halogen atom, for example, a chlorine atom, a bromine atom, a fluorine atom, etc., or a group having up to about 15 carbon atoms, preferably up to 10 carbon atoms, for example, a nitro group, a cyano group, a thiocyano group, a hydroxy group, an alkoxy group, an aryloxy group, an acyloxy group, an alkyl group, an alkenyl group, an aryl group, an amino group, a carboxy group, an acyl group, an alkoxycarbonyl group, an aryloxycarbonyl group, a carbamoyl group, an acylamino group, an imido group, an imino group, a sulfo group, an alkylsulfonyl group, an arylsulfonyl group, an alkoxyslfonyl group, an aryloxysulfonyl group, a sulfamoyl group, a sulfonamido group, a ureido group, a thioureido group, a heterocyclic group, or the like.

Of the hydroquinones represented by the general formula (II) and the couplers represented by the general formula (III) which can be used in the multilayer color photographic light-sensitive material of the present invention, compounds in which Z is a group represented by the following general formula (V) are particularly useful:

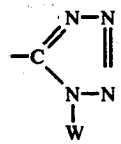

(V)

wherein W represents an aryl group [(preferably a phenyl group or a naphthyl group) which can be substituted with an alkyl group having 1 to 10 carbon atoms such as a methyl group, an ethyl group, a butyl group, an octyl group, etc.; an alkoxy group having 1 to 10 carbon atoms such as a methoxy group, a butoxy group, an octoxy group, etc.; an amido group having 2 to 10 carbon atoms such as an acetamido group, a butyramido group or a halogen atom such as a chlorine atom, a bromine atom, a fluorine atom, or an iodine atom, etc.], an alkyl group (e.g., having 1 to 10 carbon atoms such as a methyl group, an ethyl group, a butyl group, a hexyl group, an octyl group, etc.) or a heterocyclic group (such as a pyridyl group, a quinolyl group, etc.). Preferred examples of aryl groups and alkyl groups are the same as those as defined for the above-described general formula (IV).

As color couplers which can be used in the multilayer color photographic light-sensitive materials as described above, 4-equivalent couplers and 2-equivalent couplers are useful. Particularly suitable couplers are those couplers represented by the following general formulas (VI), (VII), (VIII) and (IX):

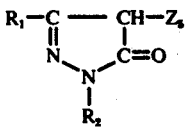

(VI)

wherein $R_1$ represents a primary, secondary or tertiary alkyl group (e.g., a methyl group, an ethyl group, a propyl group, an n-butyl group, a tert-butyl group, a hexyl group, a 2-hydroxyethyl group, a 2-phenylethyl group, a pentadecyl group, etc.), an aryl group (e.g., a phenyl group, a 2,4-di-tert-phenyl group, etc.), an alkoxy group (e.g., a methoxy group, an ethoxy group, a benzyloxy group, etc.), an aryloxy group (e.g., a phenoxy group), a heterocyclic group (e.g., a quinolinyl group, a piperidyl group, a benzofuranyl group, an oxazolyl group, etc.), an amino group (e.g., including alkylamino and arylamino groups such as a methylamino group, a diethylamino group, a phenylamino group, a tolylamino group, a 4-(3-sulfobenzamino)anilino group, a 2-chloro-5-acylaminoanilino group, a 2-chloro-5-alkoxycarbonylanilino group, a 2-trifluoromethylphenylamino group, etc.), an amido group (e.g., an amido group, an alkylcarbonamido group such as an ethylcarbonamido group, etc., an arylcarbonamido group such as a phenylcarbonamido group, a heterocyclic carbonamido group such as a benzothiazolylcarbonamido group), a sulfonamido group (e.g., a sulfonamido group, an alkylsulfonamido group, an arylsulfonamido group, a heterocyclic sulfonamido group, etc.) or a ureido group (e.g., an alkylureido group, an arylureido group, a heterocyclic ureido group, etc.); $R_2$ represents an aryl group (e.g., a naphthyl group, a phenyl group, a 2,4,6-trichlorophenyl group, a 2-chloro-4,6-dimethylphenyl group, a 2,6-dichloro-4-methoxyphenyl group, a 4-methylphenyl group, a 4-acylaminophenyl group, a 4-alkylaminophenyl group, a 4-trifluoromethylphenyl group, a 3,5-dibromophenyl group, etc.), a heterocyclic group (e.g., a benzofuranyl group, a benzothiazolyl group, a quinolyl group, etc.), or an alkyl group (e.g., a methyl group, an ethyl group, a t-butyl group, a benzyl group, etc.); and $Z_5$ represents a hydrogen atom or a group capable of being released on coupling at color development, such as a thiocyano group, an acyloxy group, an aryloxy group, an alkoxy group, an alkoxycarbonyloxy group, an aryloxycarbonyloxy group, a di-substituted amino group, an arylazo group, and a heterocyclic azo group, as described in, for example, U.S. Pat. Nos. 3,419,391, 3,252,924, 3,311,476 and 3,227,550 and U.S. Pat. application Ser. Nos. 461,204, filed Apr. 15, 1974 and 471,639, filed May 20, 1974:

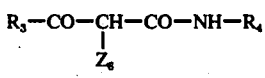

(VII)

wherein $R_3$ represents a primary, secondary, or tertiary alkyl group (e.g., a tert-butyl group, a 1,1-dimethylpropyl group, a 1,1-dimethyl-1-methoxyphenoxymethyl group, etc.), or an aryl group (e.g., a phenyl group, an alkylphenyl group such as a 2-methylphenyl group, a 3-octadecylphenyl group, etc., an alkoxyphenyl group such as a 2-methoxyphenyl group, a 4-methoxyphenyl group, etc., a halophenyl group, a 2-chloro-5-alkylcarbamidophenyl group, a 2-chloro-5-[α(2,4-di-tert-amylphenoxy)butyramido]phenyl group, a 2-methoxy-5-alkylamidophenyl group, a 2-chloro-5-sulfonamidophenyl group, etc.); $R_4$ represents a phenyl group (e.g., a 2-chlorophenyl group, 2-halo-5-alkylamidophenyl group, a 2-chloro-5-[α-(2,4-di-tert-amylphenoxy)acetamido]phenyl group, a 2-chloro-5-(4-methylphenylsulfonamido)phenyl group, a 2-methoxy-5-(2,4-di-tert-amylphenoxy)acetamidophenyl group, etc.); and $Z_6$ represents a hydrogen atom or a group capable of being released on coupling at color development, such as a halogen atom (in particular, a fluorine atom), an acyloxy group, an aryloxy group, a heterocyclic aromatic carbonyloxy group, a sulfimido group, an alkylsulfoxy group, an arylsulfoxy group, a phthalimido group, a dioxoimidazolidinyl group, a dioxooxazolidinyl group, a dioxythiazolidinyl group, a dioxymorpholino group, etc., as described in, for example, U.S. Pat. Nos. 3,227,550, 3,253,924, 3,277,155, 3,265,506, 3,408,194 and 3,415,652; U.S. Pat. application Ser. No. 454,525, filed Mar. 25, 1974; French Pat. No. 1,411,384; British Pat. Nos. 944,490, 1,040,710 and 1,118,028; and German Pat. application OLS Nos. 2,057,941, 2,163,812, 2,213,461 and 2,219,917.

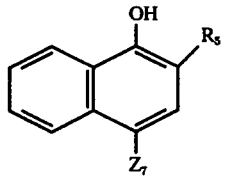

(VIII)

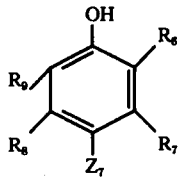

(IX)

wherein $R_5$ represents a substituent usually employed in cyan couplers, such as a carbamyl group (e.g., an alkylcarbamyl group, an arylcarbamyl group such as a phenylcarbamyl group, etc., a heterocyclic carbamyl group such as a benzothiazolylcarbamyl group, etc.), a sulfamyl group (e.g., an alkylsulfamyl group, an arylsulfamyl group such as a phenylsulfamyl group, etc., a heterocyclic sulfamyl group, etc.), a alkoxycarbonyl group, an aryloxycarbonyl group, etc.; $R_6$ represents an alkyl group, an aryl group, a heterocyclic group, an amino group, a carbamido group (e.g., an alkylcarbamido group, an arylcarbamido group, a heterocyclic carbamido group, etc.), a sulfamido group (e.g., an alkylsulfamido group, an arylsulfamido group, a heterocyclic sulfamido group, etc.), a sulfamyl group, or a carbamyl group; $R_7$, $R_8$, and $R_9$ each has the same meaning as $R_6$ and in addition represents a halogen atom or an alkyl group; and $Z_7$ represents a hydrogen atom or a group capable of being released on coupling at color development, such as a halogen atom, a thiocyano group, a cycloimido group (e.g., a maleimido group, a succinimido group, a 1,2-dicarboxyimido group, etc.), an arylazo group, or a heterocyclic azo group.

In order to render the coupler and the hydroquinone non-diffusible, a group having a hydrophobic residue containing about 8 to 32 carbon atoms is introduced in their molecule. Such a residue is called a "ballast group." The ballast group can be bonded to the coupler nucleus or the hydroquinone nucleus directly or through an imino bond, an ether bond, a carbonamido bond, a sulfonamido bond, a ureido bond, an ester bond, an imido bond, a carbamoyl bond, a sulfamoyl bond, etc.

Some examples of suitable ballast groups are described in the specific examples of the couplers of the present invention given hereinafter.

Suitable examples of the ballast group are illustrated specifically below:

I. Alkyl groups and alkenyl groups, such as $-CH_2-CH(C_2H_5)_2$, $-C_{12}H_{25}$, $-C_{16}H_{33}$, and $-C_{17}H_{33}$ II. Alkoxyalkyl groups, such as $-(CH_2)_3-O-(CH_2)_7CH_3$, and $-(CH_2)_3OCH_2-\underset{\underset{C_2H_5}{|}}{CH}-(CH_2)_8-CH_3$ as described in Japanese Pat. Publication No. 27,563/64.

III. Alkylaryl groups such as

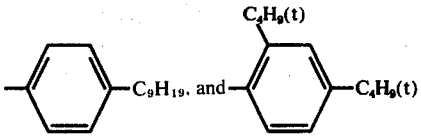

IV. Alkylaryloxyalkyl groups such as

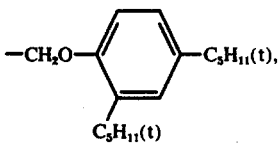

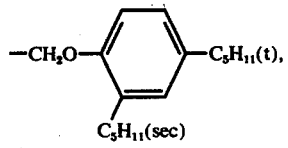

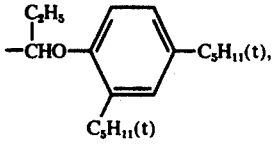

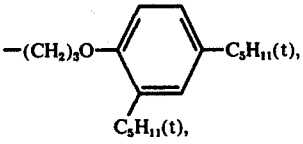

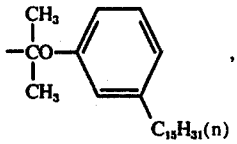

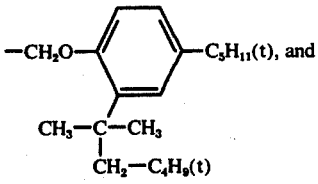

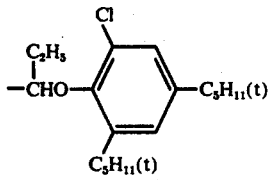

V. Acylamidoalkyl groups such as

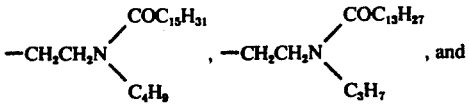

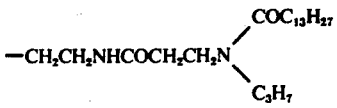

as described in U.S. Pat. Nos. 3,337,344 and 3,418,129.

VI. Alkoxyaryl groups and aryloxyaryl groups such as

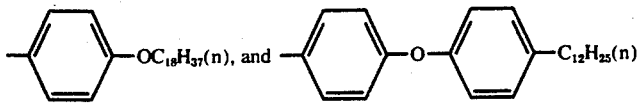

VII. Residues having both an alkyl or alkenyl long-chain aliphatic group and a carboxy or sulfo water-solubilizing group together such as $-\underset{\underset{CH_2COOH}{|}}{CH}-CH=CH-C_{16}H_{33}$, and $-\underset{\underset{SO_3H}{|}}{CH}-C_{16}H_{33}$ VIII. Alkyl groups substituted with an ester group such as $-\underset{\underset{COOC_2H_5}{|}}{CH}-C_{16}H_{33}(n)$, and $-CH_2-CH_2-COOC_{12}H_{25}(n)$ IX. Alkyl groups substituted with an aryl group or a heterocyclic group such as

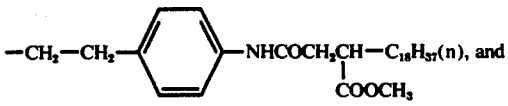

-continued

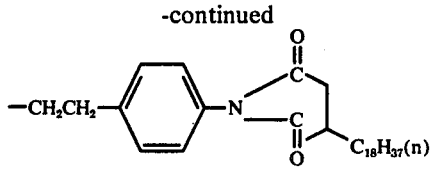

X. Aryl groups substituted with an aryloxyalkoxycarbonyl group such as

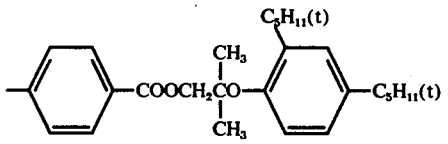

Specific examples of compounds represented by the general formulas (I), (II) and (III) which can be used in the multilayer color photographic light-sensitive materials of the present invention are illustrated below although the invention is not to be construed as being limited to these examples only.

COUPLERS OF THE GENERAL FORMULA (I)

1. 1-{4-[α-(2,4-Di-tert-amylphenoxy)acetamido]-phenyl}-3-methyl-4-(5- or 6-bromo-1-benzotriazolyl)-5-pyrazolone
2. 1-{4-[α-(2,4-Di-tert-amylphenoxy)butyramido]-phenyl}-3-methyl-4-(5- or 6-bromo-1-benzotriazolyl)-5-pyrazolone
3. 1-[4-(n-Tetradecanamido)phenyl]-3-methyl-4-(5- or 6-bromo-1-benzotriazolyl)-5-pyrazolone
4. 1-{4-[α-(2,4-Di-tert-amylphenoxybutyramido-phenyl}-3-phenyl-4-(1-benzotriazolyl)-5-pyrazolone
5. 1-(2,4,6-Trichlorophenyl)-3-(2-chloro-5-tetradecanamido)-anilino-4-(5- or 6-acetamido-1-benzotriazolyl)-5-pyrazolone
6. 1-{4-[α-(2,4-Di-tert-amylphenoxy)butyramido]-phenyl}-3-pyrrolidino-4-(1-indazolyl)-5-pyrazolone
7. 1-{4-[(3-n-Pentadecylphenoxy)acetamido]phenyl}-3-pyrrolidino-4-(5- or 6-methyl-1-benzotriazolyl)-5-pyrazolone
8. 1-(4-Acetylaminophenyl)-3-(2-methoxy-5-tetradecyloxy-carbonylanilino)-4-(5- or 6-methyl-1-benzotriazolyl)-5-pyrazolone
9. 1-(4-Acetylaminophenyl)-3-(2-methoxy-5-tetradecyloxy-carbonylanilino)-4-(5- or 6-bromo-1-benzotriazolyl)-5-pyrazolone
10. 1-(2,4-Di-tert-amylphenoxyacetylaminophenyl)-3-ethoxy-4-(5- or 6-methyl-1-benzotriazolyl)-5-pyrazolone
11. 1-Benzyl-3-(2-chloro-5-tetradecanamidoanilino)-4-(5- or 6-bromo-1-benzotriazolyl)-5-pyrazolone
12. 1-Benzyl-3-(2-chloro-5-tetradecanamidoanilino)-4-(5- or 6-methyl-1-benzotriazolyl)-5-pyrazolone
13. 1-Benzyl-3-(4-octadecyloxyanilino)-4-(5- or 6-bromo-1-benzotriazolyl)-5-pyrazolone
14. 1-Benzyl-3-(2-methyl-4-tetradecyloxyanilino)-4-(5- or 6-bromo-1-benzotriazolyl)-5-pyrazolone
15. 1-Benzyl-3-(2-chloro-5-tetradecylamidoanilino)-4-(1-benzimidazolyl)-5-pyrazolone
16. α-Benzoyl-α-(5- or 6-benzotriazolyl)-2-methoxy-5-hexadecyloxycarbonylacetanilide 17. α-Benzoyl-α-(5- or 6-methyl-1-benzotriazolyl)-2-methoxy-5-hexadecyloxycarbonylacetanilide
18. α-(4-Octadecyloxybenzoyl)-α-(1-benzotriazolyl)-2-methoxyacetanilide
19. α-(4-Octadecyloxybenzoyl)-α-(5- or 6-bromo-1-benzotriazolyl)-2-methoxyacetanilide
20. α-(4-Octadecyloxybenzoyl)-α-(5- or 6-methyl-1-benzotriazolyl)-2-methoxyacetanilide
21. α-(4-Octadecyloxybenzoyl)-α-(1-benzimidazolyl)-2-methoxyacetanilide
22. α-(4-Methoxybenzoyl)-α-(5- or 6-bromo-1-benzotriazolyl)-2-octadecyloxyacetanilide
23. α-(4-Methoxybenzoyl)-α-(5- or 6-acetylamino-1-benzotriazolyl)-2-octadecyloxyacetanilide
24. α-(4-Octadecyloxybenzoyl)-α-(5- or 6-bromo-1-benzotriazolyl)-2,5-di-methoxyacetanilide
25. α-(3,4,5-Trimethoxybenzoyl)-α-(5- or 6-bromo-1-benzotriazolyl)-2-methoxy-5-tetradecyloxycarbonylacetanilide
26. α-(2-Methoxybenzoyl)-α-(5- or 6-nitro-1-benzotriazolyl)-2-chloro-5-[α-(2,4-di-tert-amylphenoxy)butyramido]acetanilide
27. α-Pivaloyl-α-(5- or 6-bromo-1-benzotriazolyl)-5-[α-(2,4-di-tert-amylphenoxy)butyramido]-2-chloroacetanilide
28. N-[α-(2,4-Di-tert-amylphenoxy)butyryl]-ω-(5- or 6-bromo-1-benzotriazolyl)-p-aminoacetophenone
29. 4-n-Dodecyl-ω-(5- or 6-chloro-1-benzotriazolyl-)acetophenone
30. 4-n-Stearyloxy-ω-(5- or 6-nitro-1-indiazolyl-)acetophenone
31. α-Stearoyl-α-(5- or 6-bromo-1-benzotriazolyl)-2-methoxy-5-[α-(2,4-di-tert-amylphenoxy)-butyramido]acetanilide
32. 4-Tetradecyloxy-ω-[di-(5- or 6-octanamido-1-benzotriazolyl]-acetophenone
33. 3-(α-Carboxyoctadecanamido)-ω-(5- or 6-octyloxy-1-benzotriazolyl)-ω-phthalimidoacetophenone
34. Stearyl α-[5- or 6-(3-Methyl-2-benzothiazolidenyl)amino-1-benzotriazolyl]acetacetate
35. Distearyl 5- or 6-(3-Methyl-2-benzothiazolidenyl)amino-1-benzotriazolylmalonate
36. 3-Tetradecanamido-ω-[5- or 6-(3-methyl-2-benzothiazoliden)-amino-1-benzotriazolyl]ω-methanesulfanyloxyacetophenone
37. 4-Decylsulfamoyl-ω-[5- or 6-(3-methyl-2-benzothiazoliden)-amino-1-benzotriazolyl]-ω-(4-carboxyphenoxy)acetophenone
38. 1-{4-[α-(2,4-Di-tert-amylphenoxy)butyramido]-phenyl}-3-methyl-4-(5or 6-octanamido-1-benzotriazolyl)-5-pyrazolone
39. 1-Benzyl-3-[(2-methoxy-5-tetradecyloxycarbonyl)anilino]-4-(5- or 6-octanamido-1-benzotriazolyl)-5-pyrazolone
40. 1-(2,4,6-Trichlorophenyl)-3-{3-[α-(2,4-di-tert-amylphenoxy)-butyramido]benzamido}-4-(5- or 6-octanamido-1-benzotriazolyl)-5-pyrazolone
41. 1-Benzyl-3-[(3-tetradecanamido-4-methoxy)anilino]-4-(5- or 6-octanamido-1-benzotriazolyl)-5-pyrazolone
42. 1-Benzyl-3-[(2-methoxy-5-tetradecyloxycarbonyl)anilino]-4-(5- or 6-octyloxy-1-benzotriazolyl)-5-pyrazolone 43. 1-{4-[α-(2,4-Di-tert-amylphenoxy)butyramido]-phenyl}-3-methyl-4-(5- or 6-octyloxy-1-benzotriazolyl)-5-pyrazolone
44. 1-{4-[α-(2,4-Di-tert-amylphenoxy)butyramido]-phenyl}-3-methyl-4-[5- or 6-(3-methyl-2-benzothiazoliden)amino-1-benzotriazolyl]5-pyrazolone
45. 1-{4-[α-(2-Pentadecylphenoxy)-α,α-dimethylacetamido]phenyl}-4-[5- or 6-(3-methyl-2-benzothiazoliden)amino-1-benzotriazolyl]-5-pyrazolone
46. 1-Methyl-3-[(2-methoxy-5-tetradecyloxycarbonyl)anilino]-4-[5- or 6-(3-methyl-2-benzothiazoliden)amino-1-benzotriazolyl]-5-pyrazolone
47. 1-{4-[α-(2,4-Di-tert-amylphenoxy)butyramido]-phenyl}-3-methyl-4-(5- or 6-benzotriazolyl)-5-pyrazolone
48. 1-{4-[α-(2,4-Di-tert-amylphenoxy)butyramido]-phenyl}-3-(4-methoxyphenyl)-4-(5- or 6-octanamido-1-benzotriazolyl)-5-pyrazolone
49. 1-Methyl-3-[(2-methoxy-5-tetradecyloxycarbonyl)anilino]-4-(5- or 6-benzyloxy-1-benzotriazolyl)-5-pyrazolone
50. 1-{4-[α(2,4-Di-tert-amylphenoxy)butyramido]-phenyl}-3-methyl-4-[5- or 6-(4-isopropylbenzoyloxy)-1-benzotriazolyl]-5-pyrazolone
51. 1-(β-Hydroxyethyl)-3-[(2-chloro-5-tetradecanamido)anilino]-4-[5- or 6-(3-methyl-2-benzothiazoliden)amino-1-benzotriazolyl]-5-pyrazolone
52. α-Benzoyl-α-(5-benzyloxy-1-benzotriazolyl)-2-methoxy-5-tetradecyloxycarbonylacetanilide
53. α-Benzoyl-α-[5-(p-isopropylbenzyloxy)-1-benzotriazolyl]-2-methoxy-5-tetradecyloxycarbonylacetanilido
54. α-Benzoyl-α-[5-(p-hydroxybenzyloxy)-1-benzotriazolyl]-2-methoxy-5-tetradecyloxycarbonylacetanilide
55. α-Benzoyl-α-(6-hexyloxy-1-benzotriazolyl)-2-chloro-5-[(2,4-di-tert-amylphenoxy)acetamido]acetanilide
56. α-(4-Octadecyloxybenzoyl)-α-(5-octanamido-1-benzotriazolyl)-2-methoxyacetanilide
57. α-Benzoyl-α-(5-octyloxy-1-benzotriazolyl)-2-methoxy-5-tetradecyloxycarbonylacetanilide
58. α-(4-Methoxybenzoyl)-α-[6-(o-chlorobenzyloxy)]-2-chloro-5-hexadecyloxycarbonylacetanilide
59. α-(4-Octadecyloxybenzoyl)-α-(5-hexanamido-1-benzotriazolyl)-2-methoxy-5-sulfoacetanilide
60. α-Pivaloyl-α-[5-(3-ethylhexanamido)-1-benzotriazolyl]-2-chloro-5-[4-(2,4-di-tert-amylphenoxy)butyramido]acetanilide
61. α-(4-Methoxybenzoyl)-α-[5-(3-benzothiazolyl-2-thion)]-2-tetradecyloxyacetanilide
62. α-(2,4-Dimethoxybenzoyl)-α-[5-(5-mercapto-1-tetrazolyl)-1-benzotriazolyl]-4-octyloxyacetanilide
63. α-(4-Octadecyloxybenzoyl)-α-[5- or 6-(3-methyl-2-benzothiazoliden)amino-1-benzotriazolyl]-2-ethoxyacetanilide
64. 1-Hydroxy-N-[γ-(2,4-di-tert-amylphenoxy)-propyl]-4-(5-acetyl-1-benzotriazolyl)-2-naphthamide 65. 1-Hydroxy-N-[γ-(2,4-di-tert-amylphenoxy)propyl]-4-(5-octanamido-1-benzotriazolyl)-2-naphthamide
66. 1-Hyroxy-4-(5-benzoyloxy-1-benzotriazolyl)-2-(2-n-tetradecyloxy)naphthanilide
67. 1-Hydroxy-4-(5-tetradecanamido-1-benzotriazolyl)-2-(2-n-octadecyloxy)naphthanilide
68. 1-Hydroxy-4-[5-(3-methyl-2-benzothiazolidenyl-)imino-1-benzotriazolyl]-N-[δ-(2,4-di-tert-amylphenoxy)butyl]-2-naphthamide
69. 1-Hyroxy-4-[5-(2-thion-3-benzothiazolyl)-1-benzotriazolyl]-2-{2-chloro-5-[α-(2,4-di-tert-amylphenoxy)butyramido]}-naphthanilide

HYDROQUINONE DERIVATIVES OF THE GENERAL FORMULA (II)

70. 2-n-Dodecylthio-5-(1′-phenyltetrazol-5′-ylthio)-hydroquinone
71. 2-n-Octadecylthio-5-(1′-phenyltetrazol-5′-ylthio)-hydroquinone
72. 2-n-Hexadecylthio-5-(1′-phenyltetrazol-5′-ylthio)-hydroquinone
73. 2-(1′-Phenyltetrazol-5′-ylthio)-3-phenylthio-6-(1″,1″,3″,3″-tetramethylbutyl)hydroquinone
74. 2-n-Hexadecylthio-5-(1′phenyltetrazol-5′-ylthio)-6-phenylthiohydroquinone
75. 2-n-Octadecylthio-5-(1′-phenyltetrazol-5′-ylthio)-6-phenylthiohydroquinone
76. 2-n-Pentadecyl-5-(1′-phenyltetrazol-5′-ylthio)-hydroquinone 77. 2-[2′,5′-Dihydroxy-6′-methoxyacetanilide 1″-phenyltetrazol-5″-ylthio)-3′-octadecyl]phenylthiobenzoic acid methyl ester
78. 2-[2′, 5′-Dihydroxy-6′-(1″-phenyltetrazol-5″-ylthio)-3′-hexadecylthio]phenylthiobenzoic acid amyl ester
79. 2-(2-Methylthio-1′,3′,4′-thiadiazol-5′-ylthio)-6-n-pentadecylhydroquinone
80. 2-(3′-n-Pentyl-4′-phenyl-1′,2′,4′-triazol-5′-ylthio)-5-hexadecylthiohydroquinone
81. 2-(6′-Methyl-1′,3′,3a′,7′-tetraazainden-4′-ylthio)-6-(1″,1″,3″,3″-tetramethylbutyl)hydroquinone

COUPLERS OF THE GENERAL FORMULA (III)

82. α-Benzoyl-α-(2-benzothiazolythio)-4-[N-(α-phenylpropyl)-N-(4-tolyl)sulfamyl]acetanilide
83. α-Pivaloyl-α-(1-phenyltetrazolylthio)-5-[α-(2,4-di-tert-amylphenoxy)propionamido]-2-chloroacetanilide
84. α-(4-Octadecyloxybenzoyl)-α-(1-phenyltetrazolylthio)-2-methoxyacetanilide
85. α-Benzoyl-α-(1-phenyltetrazolylthio)-2-methoxy-5-hexadecyloxycarbonylacetanilide
86. 1-[α-(2,4-Di-tert-amylphenoxy)butyramidophenyl]-3-dibutylamido-4-(1-phenyltetrazolylthio)-5-pyrazolone
87. 1-[α-(3-Pentadecylphenoxy)propionamidophenyl]-3-diethylamino-4-(2-benzothiazolylthio)-5-pyrazolone
88. 1-[α-(2,4-Di-tert-amylphenoxy)butyramidophenyl]-3-dibenzylamino-4-(1-phenyltetrazolylthio)-5-pyrazolone 89. 1-[α-(2,4-Di-tert-amylphenoxy)propionamidophenyl]-3-pyrrolidino-4-(1-phenyltetrazolylthio)-5-pyrazolone
90. 1-[α-(3-Pentadecylphenoxy)acetamidophenyl]-3-ethoxy-4-(1-phenyltetrazolylthio)-5-pyrazolone
91. 1-[α-(2,4-Di-tert-amylphenoxy)butyramidophenyl]-3-(4-methoxyanilino)-4-(1-phenyltetrazolylthio)-5-pyrazolone
92. 1-[α-(2,4-Di-tert-amylphenoxy)butyramidophenyl]-3-(2,4-dimethylanilino)-4-(1-acetylaminotetrazolylthio)-5-pyrazolone
93. 1-[α-(2,4-Di-tert-amylphenoxy)acetamidophenyl]-3-(2,4-dimethylanilino)-4-(1-phenyltetrazolylthio)-5-pyrazolone 94. 1-Benzyl-3-(2-chloro-5-dodecylamidoanilino)-4-(1-phenyltetrazolylthio)-5-pyrazolone
95. 1-(2,4,6-Trichlorophenyl)-3-(2-chloro-4-tetradecylamidoanilino)-4-(1-phenyltetrazolylthio)-5-pyrazolone
96. 1-Hyroxy-4-(1-phenyltetrazolylthio)-N-[-(2,4-di-tert-amylphenoxy)propionyl]-2-naphthamide
97. 1-Hydroxy-4-(1-phenyltetrazolylthio)-(2-chloro-5-hexadecyloxycarbonyl)-2-naphthanilide
98. 1-Hyroxy-4-(1-phenyltetrazolylthio)-]2-methoxy-5-(2,4-di-tert-amylphenoxy)acetylamino]-2-naphthanilide
99. 2-[α-(2,4-Di-tert-amylphenoxy)butyramido]-4-(1-phenyltetrazolylthio)-5-methyl-5-chlorophenol As couplers which can be used in the present invention those having a ballast group as described in U.S. Pat. Nos. 2,920,961, 2,875,057, 3,418,129, 3,658,544, 3,681,076, 3,062,653 and 2,474,293; British Pat. No. 1,201,943; German Pat. application OLS No. 2,216,578; and U.S. Pat. application Ser. Nos. 455,090, filed Mar. 27, 1974 and 480,456, filed June 18, 1974 and the like are preferred.

As yellow couplers which can be used in the present invention, those described in U.S. Pat. Nos. 3,265,506, 2,728,658, 3,369,895, 3,582,322, 3,408,194, 3,415,652 and 3,253,924; British Pat. Nos. 1,286,411, 1,040,710, 1,302,398 and 1,204,680; German Pat. application OLS Nos. 1,956,281, 2,162,899 and 2,213,461; U.S. Pat. application Ser. No. 319,806, filed Dec. 29, 1972 and the like are suitable.

As magenta couplers which can be used in the present invention, those described in U.S. Pat. Nos. 2,600,788, 3,559,319, 3,468,666, 3,419,391, 3,311,476, 3,253,924 and 3,311,476; British Pat. No. 1,293,640; U.S. Pat. application Ser. Nos. 445,032, filed Feb. 22, 1974 and 462,842, filed Apr. 22, 1974 and the like suitable.

As cyan couplers which can be used in the present invention, those described in U.S. Pat. Nos. 2,369,929, 2,474,293, 3,591,383, 2,895,826, 3,568,315, 3,311,476, 3,419,390, 3,476,563 and 3,253,924; British Pat. No. 1,201,110 and the like are suitable.

Colored couplers which can be used in the present invention include the following couplers.

As colored magenta couplers, those described in U.S. Pat. Nos. 2,434,272, 3,476,564 and 3,476,560; Japanese Pat. application No. 45,971/73, and the like are suitable.

As colored cyan couplers, those described in U.S. Pat. Nos. 3,034,892, 3,386,301 and 2,434,272, and the like are suitable.

Specific examples of couplers which can be used together with the compounds represented by the general formulas (I), (II) and (III) in the multilayer color photographic light-sensitive materials of the present invention are illustrated below although the invention is not to be construed as being limited to these examples only.

YELLOW COUPLERS

100. α-{3-[α-(2,4-Di-tert-amylphenoxy)-butyramido]benzoyl}-2-methoxyacetanilide
101. α-Acetoxy-α-3-[γ-(2,4-di-tert-amylphenoxy)-butyramido]benzoyl-2-methoxyacetamilide
102. N-(4-Anisoylacetamidobenzenesulfonyl)-N-benzyl-N-toluidine
103. α-(2,4-Dioxo-5,5-dimethyloxazolidinyl)-α-pivaloyl-2-chloro-5-[α-(2,4-di-tert-amylphenoxy)-butyramido]acetanilide
104. α-(4-Carboxyphenoxy)-α-pivaloyl-2-chloro-5-[α-(2,4-di-tert-amylphenoxy)butyramido]acetanilide
105. α-[3-(1-Benzyl-2,4-dioxo)hydantoin]-α-pivaloyl-2-chloro-5-[α-(2,4-di-tert-amylphenoxy)-butyramido]acetanilide
106. α-(4-Methoxybenzoyl)-α-(3,5-dioxomorpholino)-5-[γ-(2,4-di-tert-amylphenoxy)-butyramido]-2-chloroacetanilide

MAGENTA COUPLERS 107. 1-(2,4,6-Trichlorophenyl)-3-[3-(2,4-di-tert-amylphenoxyacetamido)benzamido]-5-pyrazolone
108. 1-(2,4,6-Trichlorophenyl)-3-{3-[α-(2,4-di-tert-amylphenoxy)acetamido]benzamido}-4-acetoxy-5-pyrazolone
109. 1-(2,4,6-Trichlorophenyl)-3-tridecylamido-4-(4-hydroxyphenyl)azo-5-pyrazolone
110. 1-(2,4,6-Trichlorophenyl)-3-[(2-chloro-5-tridecanoylamino)anilino]-5-pyrazolone
111. 1-(2,4,6-Trichlorophenyl)-3-(2-chloro-5-tetradecyloxycarbonyl)anilino-4-(1-naphthylazo)-5-pyrazolone
112. 1-(2,4-Di-chloro-6-methoxyphenyl)-3-[(2-chloro-5-tridecanoylamino)anilino]-4-benzyloxycarbonyloxy-5-pyrazolone
113. 1-(2,4,6-Trichlorophenyl)-3-{3-[(2,4-di-tert-amylphenoxy)acetamido]benzamido}-4-piperidino-5-pyrazolone
114. 1-(2,4,6-Trichlorophenyl)-3-{2-chloro-5-[α-(2,4-di-tert-amylphenoxy)butyramido]anilino}-4-N-phthalimido-5-pyrazolone
115. 1-(2,4,6-Trichlorophenyl)-3-(2-chloro-5-tetradecylaminoanilino-4-(3-methyl-4-hydroxyphenylazo)-5-pyrazolone

CYAN COUPLERS 116. 1-Hydroxy-N-[γ-(2,4-di-tert-amylphenoxypropyl)]-2-naphthamide
117. 1-Hydroxy-4-[2-(2-hexyldecyloxycarbonyl)-phenylazo]-2-[N-(1-naphthyl)]naphthamide
118. 1-Hydroxy-4-chloro-N-[α-(2,4-di-tert-amylphenoxy)butyl]-2-naphthamide
119. 5-Methyl-4,6-dichloro-2-[α-(3-n-pentadecylphenoxy)butyramino]phenol
120. 1-Hydroxy-4-(2-ethyloxycarbonylphenylazo)-N-(2-ethylamyl)-2-naphthamide The DIR compounds which can be used in the present invention include various kinds of compounds.

As DIR yellow couplers, those described in U.S. Pat. Nos. 3,148,062, 3,227,554, 3,701,783 and 3,617,291 and the like are suitable.

As DIR magenta couplers, those described in U.S. Pat. Nos 3,148,062, 3,227,554, 3,701,783 and 3,617,291; U.S. Pat. application Ser. No. 454,525, filed Mar. 25, 1974 and the like are suitable.

As DIR cyan couplers, those described in U.S. Pat. Nos. 3,418,062, 3,227,554, 3,701,783, 3,617,291, 3,622,328, and 3,790,384; Japanese Pat. Publication No. 28,836/70, and the like are suitable.

As DIR hydroquinones, those described in U.S. Pat. Nos. 3,379,529, 3,639,417 and 3,297,445; U.S. Pat. application Ser. No. 494,955, filed Aug. 5, 1974, and the like are suitable Further, as other non-color forming DIR compounds, those described in U.S. Pat. Nos. 3,632,345 and 3,227,554 and the like are suitable.

As non-color forming couplers which can be used in the present invention, those described in British Pat. Nos. 861,138, 914,145 and 1,109,963; Japanese Pat. Publication No. 14,033/70; U.S. Pat. No. 3,580,722, *Mitteilungeu aus den Forschung Laboratory in der Agfa Leberkusen*, Vol. 4, pages 352 to 367 (1964), and the like are suitable.

Furthermore, as competing couplers which can be used in a developer solution or in an emulsion layer, those as described in British Pat. Nos. 861,138, 1,204,964 and 904,365; U.S. Pat. Nos. 3,174,862, 3,520,690, 2,742,832, 2,560,212, 3,645,737 and 2,689,783; Japanese Pat. Publication Nos. 9,505/69, 9,506/69 and 9,507/69, and the like are suitable.

The couplers according to the present invention can be classified into Fischer type couplers having a water solubilizing group such as a carboxy group, a hydroxy group of a sulfo group and hydrophobic couplers. Methods of adding the couplers to emulsions and dispersion therein and methods of adding them to gelatin silver halide emulsions or hydrophilic colloids hitherto known can be employed in this invention. For example, a method of dispersing a coupler by mixing with an organic solvent having a high boiling point such as dibutyl phthalate or tricresyl phosphate, a fatty oil which is liquid at room temperature (about 20 ~ 30° C), a wax, a higher fatty acid or ester thereof, for example, the method described in U.S. Pat. Nos. 2,304,939 and 2,322,027, a method for dispersing a coupler by mixing the coupler with an organic solvent having a low boiling point or a water-soluble organic solvent, a method for dispersing a coupler using an organic solvent having a high boiling point together with the above-described organic solvent having a low boiling point or a water-soluble solvent, for example, the method described in U.S. Pat. Nos. 2,801,170, 2,801,171, and 2,949,360, and a method of dispersing a coupler having a low melting point (e.g., below about 75° C) individually or together with other couplers, for example, a colored coupler or an uncolored coupler, for example, the method described in German Pat. No. 1,143,707, can be used.

Dispersion assistants which can be used include anionic surface active agents (for example, sodium alkylbenzene sulfonates, sodium dioctyl sulfosuccinate, sodium dodecyl sulfate, sodium alkylnaphthalene sulfonates and Fischer type couplers, and the like), amphoteric surface active agents (for example, N-tetradecyl-N,N-di-polyethylene-$\alpha$-betaine, and the like) and nonionic surface active agents (for example, sorbitan monolaurate, and the like) which are conventionally used.

The couplers are, generally, used in a molar ratio of about 0.01:1 to 0.5:1 to the silver halide. The ICC coupler of the present invention of the general formula (I) can be used individually or as a mixture with the hydroquinone derivative represented by the general formula (II) and/or another coupler, and the ICC coupler of the present invention of the general formula (I) is used in the amount below about 50% by mol, and preferably below 20% by mol, based on the total amount of couplers used in the photographic light-sensitive material according to the present invention.

The hydroquinone derivative which is represented by the general formula (II) according to the present invention can be used by dispersing the hydroquinone derivative of the general formula (II) in the same manner as that of hydrophobic couplers. Preferably, the hydroquinone derivative of the general formula (II) is used by mixing with a hydrophobic coupler or with a known hydroquinone derivative used hitherto. The hydroquinone derivative represented by the general formula (II) can be used individually or as a mixture in various ratios. The hydroquinone derivative of the general formula (II) is preferably used in the amount below about 20% by mol, based on the total amount of couplers used.

Also, the hydroquinone derivative of the invention represented by the general formula (II) can be used individually or as a mixture with a known hydroquinone derivative used hitherto in a gelatin intermediate layer.

A coupler which releases a compound having a mercapto group by coupling with an oxidized primary aromatic amine developing agent can be used in the present invention in the same manner as that of the ICC coupler of the general formula (I) described above.

The silver halide emulsions used for the light-sensitive emulsion layers in the present invention are those wherein silver chloride, silver bromide or a mixed silver halide such as silver chlorobromide, silver iodobromide or silver chloroiodobromide is finely dispersed in a hydrophilic polymer such as gelatin. The silver halide is chosen depending on the purpose of use of the photographic light-sensitive material and the silver halides can be those having a uniform grain size or those having a wide grain size distribution or those having an average grain size of about 0.01 micron to about 3 microns. These silver halide emulsions can be prepared, for example, by a single jet method, by a double jet method or a controlled double jet method, or by a method of ripening such as an ammonia method, a neutral method or an acid method, and the like.

The silver halide emulsions used for the light-sensitive emulsion layer in the present invention can be sensitized using conventional chemical sensitization methods. For example, a gold sensitization method such as is described in U.S. Pat. Nos. 2,399,083, 2,597,856 and 2,597,915, a reduction sensitization method such as is described in U.S. Pat. Nos. 2,487,850 and 2,521,925, a sulfur sensitization method such as is described in U.S. Pat. Nos. 1,623,499 and 2,410,689, a method of sensitizing using metal ions other than silver such as is described in U.S. Pat. Nos. 2,448,060, 2,566,245 and 2,566,263, or a combination of these methods can be employed.

Spectral sensitization methods conventionally used in color photographic light-sensitive materials can also be employed.

The photographic emulsions can be spectrally sensitized or supersensitized, if desired, using a cyanine dye such as cyanine, merocyanine, carbocyanine or styryl dyes, individually or in combination. Spectral sensitization techniques are well known, and are described, for example, in U.S. Pat. Nos. 3,493,748, 2,519,001, 2,977,229, 3,480,434, 3,672,897, 3,703,377, 2,688,545, 2,912,329, 3,397,060, 3,615,635 and 3,628,964; British Pat. Nos. 1,195,302, 1,242,588 and 1,293,862; German Pat. application OLS Nos. 2,030,326 and 2,121,780; Japanese Pat. Publication Nos. 4,936/68, 14,030/69 and 10,773/68; U.S. Pat. Nos. 3,511,664, 3,522,052, 3,527,641, 3,615,613, 3,615,632, 3,617,295, 3,635,271 and 3,694,217; and British Pat. Nos. 1,137,580 and 1,216,203, and the like. The sensitizers can be chosen as desired depending on the purposes and uses of the photographic materials to be sensitized.

Further, a conventionally used stabilizer such as a 4-hydroxy-1,3,3*a*,7-tetraazaindene derivative, an antifogging agent such as a mercapto compound or a benzotriazole derivative, a coating aid, a hardening agent, a wetting agent or a sensitizing agent, for example, an onium derivative such as a quaternary ammonium salt as described in U.S. Pat. Nos. 2,271,623, 2,288,226 and 2,334,864 or a polyalkylene oxide derivative described in U.S. Pat. Nos. 2,708,162, 2,531,832, 2,533,990, 3,210,191 and 3,158,484 can be employed. Further, a dye for preventing irradiation can be employed. Additionally, a filter layer, a mordanted color layer or a hydrophobic dye containing color layer can be included as a layer element of the color photographic light-sensitive materials of the present invention.

Examples of hydrophilic colloids which can be used as a binder for the silver halide grains include, for example, gelatin, colloidal albumin, casein, a cellulose derivative such as carboxymethylcellulose and hydroxyethylcellulose, a polysaccharide derivative such as agar-agar, sodium alginate and a starch derivative, a synthetic hydrophilic colloid such as polyvinyl alcohol, poly-N-vinyl pyrrolidone, polyacrylic acid copolymers and polyacrylamide, or the derivatives or partially hydrolyzed products thereof. If desired, a compatible mixture of these colloids can also be employed. Of these colloids, gelatin is most commonly used. The gelatin can be replaced partially or completely by a synthetic polymer, by a so-called gelatin derivative such as those prepared by reacting or modifying the amino, imino, hydroxy or carboxy groups contained, as functional groups, in the gelatin molecule with a compound having a group capable of reacting with the above-described groups, or a graft gelatin such as those prepared by grafting other polymer chains on the gelatin molecule.

Examples of suitable compounds which can be used for the preparation of the above-described gelatin derivatives include isocyanates, acid chlorides and acid anhydrides such as those described in U.S. Pat. No. 2,614,928; acid anhydrides such as those described in U.S. Pat. No. 3,118,766; bromoacetic acids such as those described in Japanese Pat. Publication No. 5,514/64; phenyl glycidyl ethers such as those described in Japanese Pat. Publication No. 26,845/67; vinylsulfones such as those described in U.S. Pat. No. 3,132,945; N-allyl-vinylsulfonamides such as those described in British Pat. No. 861,414; maleinimides such as those described in U.s. Pat. No. 3,186,846; acrylonitriles such as those described in U.S. Pat. No. 2,594,293; polyalkylene oxides such as those described in U.S. Pat. No. 3,312,553; epoxy compounds such as those described in Japanese Pat. Publication No. 26,845/67; esters such as those described in U.S. Pat. No. 2,763,639; and alkane sultones such as those described in British Pat. No. 1,033,189.

As polymers grafted to gelatin, a wide variety of polymers or copolymers can be employed including those obtained from the so-called vinyl monomers such as acrylic acid, methacrylic acid or their derivatives, e.g., the ester, amide and nitrile derivatives; or styrene. Other examples of such polymers are described in U.S. Pat. Nos. 2,763,625, 2,831,767 and 2,956,884; *Polymer Letters*, 5 595 (1967); *Phot. Sci. Eng.*, 9 148 (1965); and *J. Polymer Sci.*, A-1, 9 3199 (1971). Hydrophilic polymers or copolymers having a certain degree of compatibility with gelatin such as those prepared from acrylic acid, acrylamide, methacrylamide, hydroxyalkylacrylates, hydroxyalkylmethacrylates and the like are particularly desirable.

The emulsion layers of the invention can be hardened using conventional methods. Examples of suitable hardeners include, for example, aldehyde type compounds such as formaldehyde and glutaraldehyde; ketone compounds such as diacetyl and cyclopentadione; reactive halogen-containing compounds such as bis(2-chloro-ethylurea), 2-hydroxy-4,6-dichloro-1,3,5-triazine and those described in U.S. Pat. Nos. 3,288,775 and 2,732,303; and British Pat. Nos. 794,723 and 1,167,207; reactive olefin-containing compounds such as divinyl sulfone, 5-acetyl-1, 3-diacryloylhexahydro-1,3,5-triazine and those described in U.S. Pat. Nos. 3,635,718 and 3,232,763; and British Pat. No. 994,869; N-methylol compounds such as N-hydroxymethylphthalimide and those described in U.S. Pat. Nos. 2,732,316 and 2,586,168; isocyanate compounds such as those described in U.S. Pat. No. 3,103,473; aziridine compounds such as those described in U.S. Pat. Nos. 3,017,280 and 2,983,611; acid derivatives such as those described in U.S. Pat. Nos. 2,725,294 and 2,725,295; carbodiimide compounds such as those described in U.S. Pat. No. 3,100,704; epoxy compounds such as those described in U.S. Pat. No. 3,091,537; isooxazole compounds such as those described in U.S. Pat. Nos. 3,321,313 and 3,543,292; halocarboxyaldehydes such as mucochloric acid; dioxane derivatives such as dihydroxydioxane and dichlorodioxane; and inorganic hardeners such as chrome alum and zirconium sulfate. In addition to the above compounds, presursors of hardeners such as the alkali metalbisulfite-aldehyde adducts, methylol derivatives of hydantoin, primary fatty nitro alcohols and the like can also be used.

The light-sensitive emulsion used in the present invention can be applied to various supports. For example, a cellulose acetate film, a polyethylene terephthalate film, a polyethylene film, a polypropylene film, a glass plate, a baryta coated paper, a resin laminated paper, a synthetic paper, and the like can be used.

The photographic light-sensitive materials of the present invention are developed using color developers containing p-phenylenediamine derivatives or p-aminophenol derivatives as color developing agents. Preferred examples of p-phenylenediamine derivatives include p-amino-N-ethyl-N-$\beta$-(methanesulfonamidoethyl)m-toluidine sesquisulfate monohydrate, diethylamino-p-phenylene-diamine sesquisulfite, p-amino-N,N-diethyl-n-toluidine hydrochloride and p-amino-N-ethyl-N-$\beta$-hydroxyethylaniline sesquisulfate monohydrate, etc. Furthermore, known developers for color negative light-sensitive materials, color negative or color positive light-sensitive materials for cinema use, color papers or instant color light-sensitive materials can be used. For example, the color development processing described in Japanese Pat. Pubilcation No. 35,749/70, Japanese Pat. application Nos. 67,798/69, 13,313/71 and 19,516/71, H. Gordon, *The British Journal of Photography*, page 558 et seq., Nov. 15, 1954, ibid., page 440 et seq., Sept. 9, 1955 and ibid., page 2 et seq., Jan. 6, 1956, S. Horwitz, ibid., page 212 et seq., Apr. 22, 1960, E. Gehret, ibid., page 122 et seq., Mar.

4, 1960 and ibid., page 396 et seq., May 7, 1965, J. Meech, ibid., page 182 et seq., Apr. 3, 1959, German Pat. application OLS No. 2,238,051, and the like can be used. The photographic light-sensitive materials of the present invention can be developed at a temperature of about 20° C or less to 65° C or more. The photographic materials of the present invention are particularly suitable for developing at a relatively high temperature such as above 30° C or more without adverse effects on the graininess of images formed.

After color development, the photographic light-sensitive materials of the present invention are subjected to a bleaching treatment in a conventional manner. The bleaching can be performed separately or simultaneously with a fixing. The processing solution for the bleaching can include a fixing agent to form a blix bath, if desired. Many compounds can be used as bleaching agents. Of these compounds, ferricyanides; bichromates; water-soluble cobalt (III) salts, water-soluble copper (II) salts; water-soluble quinones; nitrosophenols; complexes of a polyvalent metal such as iron (III), cobalt (III), copper (II), etc., especially a complex of a polyvalent cation and an organic acid, for example, an aminopolycarboxylic acid such as ethylenediaminetetraacetic acid, nitrilotriacetic acid, iminodiacetic acid, N-hydroxy-ethylethylenediaminetriacetic acid, etc., malonic acid, tartaric acid, malic acid, diglycolic acid and dithioglycolic acid, and 2,6-dipicolinic acid; peracids such as alkylperacids, persulfates, permanganates and peroxides; hypochlorites; chlorine; bromine; and the like can be suitably used, individually or in combination.

A bleaching accelerator such as those described in U.S. Pat. Nos. 3,042,520 and 3,241,966; and Japanese Pat. Publication Nos. 8,506/70 and 8,836/70 and other various additives can be added to the bleaching solution.

Some examples of the present invention are illustrated below in order to facilitate a better understanding of the embodiments and other objects of the present invention. However, the present invention is not to be construed as being limited to these examples. Unless otherwise indicated herein, all parts, percents, ratios and the like are by weight.

EXAMPLE 1

The following eight layers were applied to a transparent cellulose triacetate film support as illustrated in FIG. 1 to prepare a multilayer color photographic light-sensitive material (Sample A).

FIRST LAYER: ANTIHALATION LAYER 1 kg of a 5% aqueous gelatin solution containing black colloidal silver and 1 g of Hardener (H) was applied in a dry thickness of 1 $\mu$.

SECOND LAYER: INTERMEDIATE LAYER 250 g of Emulsion I which was prepared by dissolving 50 g of 2,5-di-tert-octylhydroquinone in 100 cc of tricresyl phosphate and 200 cc of ethyl acetate and emulsifying the resulting solution in 1 kg of a 10% aqueous gelatin solution using 5 g of Aerosol OT (trade name for sodium dioctylsulfosuccinate, produced by American Cyanamide Co.), was mixed with 1 kg of a 10% aqueous gelatin solution. To the mixture 1 g of Hardener (H) was added, and the composition was applied in a dry thickness of 1 $\mu$.

THIRD LAYER: RED-SENSITIVE EMULSION LAYER 1 kg of a silver iodobromide emulsion (silver content: 0.6 mol, iodide content: 7 mol%, average grain size: 0.6 $\mu$) was spectrally sensitized using $4 \times 10^{-5}$ mol of Sensitizing Dye I and $1 \times 10^{-5}$ mol of Sensitizing Dye II. To the emulsion 420 g of Emulsion II which was prepared by dissolving 100 g of Coupler (116) and 20 g of Hydroquinone Compound (75) in 100 cc of dibutyl phthalate and 200 cc of ethyl acetate and emulsifying in the same manner as in Emulsion I and 0.8 g of Hardener (H) were added. The emulsion was applied in a dry thickness of 4.5$\mu$.

FOURTH LAYER: INTERMEDIATE LAYER

The same as the Second Layer.

FIFTH LAYER: GREEN-SENSITIVE EMULSION LAYER 1 kg of a silver iodobromide emulsion as described for the Third Layer was spectrally sensitized using $2 \times 10^{-4}$ mol of Sensitizing Dye III and $6 \times 10^{-5}$ mol of Sensitizing Dye IV. To the emulsion, 600 g of Emulsion III which was prepared by dissolving 80 g of Coupler (107), 20 g of ICC coupler (11) and 20 g of Hydroquinone Compound (75) in 100 cc of tricresyl phosphate and 200 cc of ethyl acetate and emulsifying in the same manner as in Emulsion I and 1 g of Hardener (H) was added. The emulsion was applied in a dry thickness of 4 $\mu$.

SIXTH LAYER: YELLOW FILTER LAYER 1 kg of an aqueous gelatin solution containing yellow colloidal silver, 200 g of Emulsion I and 1 g of Hardener (H) was applied in a dry thickness of 1 $\mu$.

SEVENTH LAYER: BLUE-SENSITIVE EMULSION LAYER

To a lkg of silver iodobromide emulsion as described for the Third Layer, 500 g of Emulsion IV which was prepared by dissolving 100 g of Coupler (113) in 100 cc of dibutyl phthalate and 200 cc of ethyl acetate and emulsifying in the same manner as in Emulsion I and 1 g of Hardener (H) were added. The emulsion was applied in a dry thickness of 3 $\mu$.

EIGHTH LAYER: PROTECTIVE LAYER 1 kg of a 10% aqueous gelatin solution containing 1 g of Hardener (H) was applied in a dry thickness of 1 $\mu$. The components employed in the above layers were as follows.

Hardener (H): 2,6-Dichloro-4-oxytriazine sodium salt (added as a 2% aqueous solution)

Sensitizing Dye I: Anhydro-5,5'-dichloro-3,3'-disulfopropyl-9-ethylthiacarbocyanine hydroxide pyridinium salt Sensitizing Dye II: Anhydro-9-ethyl-3,3'-di-(3-sulfopropyl)-4,5,4',5'-di-benzothiacarbocyanine hydroxide triethylamine salt Sensitizing Dye III: Anhydro-9'-ethyl-5,5'-dichloro-3,3'-disulfopropyloxycarbocyanine sodium salt Sensitizing Dye IV: Anhydro-5,6,5',6'-tetrachloro-1,1'-diethyl-3,3'-disulfopropoxyethoxyethylimidazolocarbocyanine hydroxide sodium salt Sample B was prepared in the same manner as Sample A using 100 g of Coupler (107) in place of 80 g of Coupler (107) and 20 g of Coupler (11) in the Fifth Layer of Sample A.

Sample C was prepared in the same manner as Sample A except that Hydroquinone Compound (75) was not used in the Third Layer and the Fifth Layer of Sample A.

Sample D was prepared in the same manner as Sample A using 100 g of Coupler (69) in place of 80 g of Coupler (107) and 20 g of Coupler (11) in the Fifth Layer and without using Hydroquinone Compound (75) in the Third Layer and the Fifth Layer of Sample A.

Samples A to D were formed in 35 mm color negative light-sensitive materials and were photographically exposed using a still camera. Then Samples A to D were processed at 38° C according to the following processing steps.

| | | |
|---|---|---|
| 1. | Color Development | 3 min. and 15 sec. |
| 2. | Bleaching | 6 min. and 30 sec. |
| 3. | Washing | 3 min. and 15 sec. |
| 4. | Fixing | 6 min. and 30 sec. |
| 5. | Washing | 3 min. and 15 sec. |
| 6. | Stabilizing | 3 min. and 15 sec. |

The compositions of the processing solutions used in the respective steps were as follows.

| | |
|---|---|
| Color Developer Solution: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 l |
| Bleaching Solution: | |
| Ammonium Bromide | 160.0 g |
| Aqueous Ammonia (28%) | 25.0 ml |
| Sodium Ethylenediaminetetraacetate Iron Salt | 130 g |
| Glacial Acetic Acid | 14 ml |
| Water to make | 1 l |
| Fixing Solution: | |
| Sodium Tetrapolyphosphate | 2.0 g |
| Sodium Sulfite | 4.0 g |
| Ammonium Thiosulfate (70% aq. soln.) | 175.0 ml |
| Sodium Bisulfite | 4.6 g |
| Water to make | 1 l |
| Stabilizing Solution: | |
| Formalin (40% aq. soln.) | 8.0 ml |
| Water to make | 1 l |

In comparison with the color negative obtained from Sample D, the color negative obtained from Sample B was improved only in sharpness and graininess, while the color negative obtained from Sample C was improved only in color purity and slightly in sharpness. On the contrary, the color negative obtained from Sample A which was a color photographic light-sensitive material according to the present invention was further improved in sharpness and graininess and, in particular, in color purity comparing with that obtained from Sample B, and in color purity and, in particular, in sharpness and graininess comparing with that obtained from Sample C. It was found that the color negative obtained from Sample A had excellent properties.

EXAMPLE 2

Figure 2:
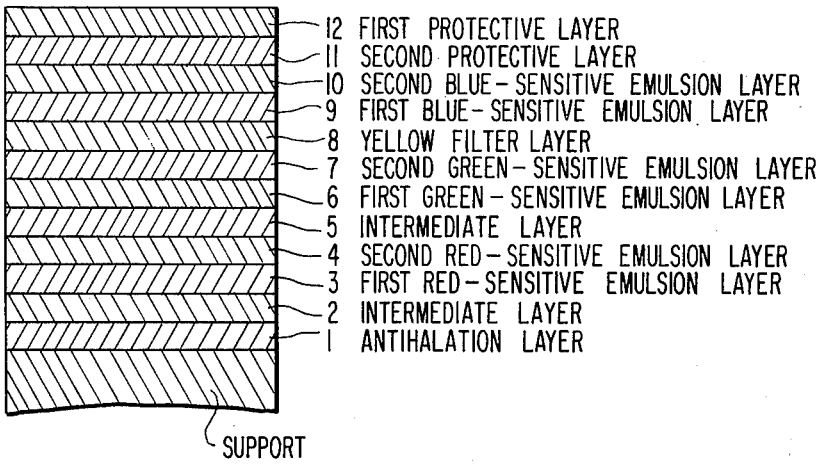

In a manner similar to Example 1, a multilayer color photographic light-sensitive material (Sample E), as illustrated in FIG. 2, was prepared. The compositions of each coating layer were as follows.

FIRST LAYER: ANTIHALATION LAYER

The same as the First Layer of Sample A (dry thickness: 1 μ).

SECOND LAYER: INTERMEDIATE LAYER

The same as the Second Layer of Sample A (dry thickness: 1 μ).

THIRD LAYER: FIRST RED-SENSITIVE EMULSION LAYER

Silver iodobromide emulsion (iodide content: 7 mol%; average grain size: 0.4 μ; silver content: 5.1%; gelatin content: 6.2%): coating amount of silver: 1.1 g/m²
Sensitizing Dye I (as described in Example 1): $5 \times 10^{-5}$ mol per mol of silver
Sensitizing Dye II (as described in Example 1): $1.2 \times 10^{-5}$ mol per mol of silver
Coupler (116): 0.09 mole per mol of silver
Hydroquinone Compound (71): 0.005 mol per mol of silver
Coupler (120): 0.02 mole per mol of silver
Hardener (H): 20 mg/m²
(dry thickness: 2 μ)

FOURTH LAYER: SECOND RED-SENSITIVE EMULSION LAYER

Silver iodobromide emulsion (iodide content: 8 mol%; average grain size: 0.7 μ; silver content: 4.9%; gelatin content: 6.5%): coating amount of silver: 1.2 g/m²
Sensitizing Dye I: $3 \times 10^{-5}$ mol per mol of silver
Sensitizing Dye II: $1.2 \times 10^{-5}$ mol per mol of silver
Coupler (116): 0.02 mol per mol of silver
Coupler (16): 0.02 mol per mol of silver
Coupler (120): 0.04 mol per mol of silver
Hardener (H): 15 mg/m²
(dry thickness: 1.5 μ)

FIFTH LAYER: INTERMEDIATE LAYER

The same as the Second Layer of Sample A.

SIXTH LAYER: FIRST GREEN-SENSITIVE EMULSION LAYER

Silver iodobromide emulsion (the same as that used in the Third Layer): coating amount of silver: 1.5 g/m²
Sensitizing Dye III (as described in Example 1): $3 \times 10^{-5}$ mol per mol of silver
Sensitizing Dye IV (as described in Example 1): $1 \times 10^{-5}$ mol per mol of silver
Coupler (107): 0.05 mol per mol of silver
Coupler (9): 0.01 mol per mol of silver
Coupler (109): 0.01 mol per mol of silver
Hardener (H): 25 mg/m²
(dry thickness: 2.3 μ)

SEVENTH LAYER: SECOND GREEN-SENSITIVE EMULSION LAYER-CONTINUED

Silver iodobromide emulsion (iodide content: 6 mol%; average grain size: 0.65 μ; silver content: 5.3%; gelatin content: 6.0%): coating amount of silver: 2.0 g/m²
Sensitizing Dye III: $2.4 \times 10^{-5}$ mol per mol of silver
Sensitizing Dye IV: $0.8 \times 10^{-5}$ mol per mol of silver
Coupler (107): 0.005 mol per mol of silver
Coupler (9): 0.003 mol per mol of silver
Hydroquinone Compound (71): 0.001 mol per mol of silver
Coupler (109): 0.015 mol per mol of silver
Hardener (H): 20 mg/m²
(dry thickness: 1.7 μ)

EIGHTH LAYER: YELLOW FILTER LAYER

The same as the Sixth Layer of Sample A (dry thickness: 1 μ).

NINTH LAYER: FIRST BLUE-SENSITIVE EMULSION LAYER

| | |
|---|---|
| Silver iodobromide emulsion (the same as that used in the Third Layer): | coating amount of silver: 1.1 g/m² |
| Coupler (113): | 0.21 mol per mol of silver |
| Coupler (16): | 0.04 mol per mol of silver |
| Hardener (H): | 20 mg/m² |
| (dry thickness: 2 μ) | |

TENTH LAYER: SECOND BLUE-SENSITIVE EMULSION LAYER

| | |
|---|---|
| Silver iodobromide emulsion (iodide content: 6%; average grain size: 0.65 μ; silver content: 5.3%; gelatin content: 6.0%): | coating amount of silver: 1.2 g/m² |
| Coupler (113): | 0.06 mol per mol of silver |
| Hardener (H): | 18 mg/m² |
| (dry thickness: 1.3 μ) | |

ELEVENTH LAYER: FIRST PROTECTIVE LAYER

| | |
|---|---|
| Silver bromide emulsion (average grain size: 0.01 μ; silver content: 6.5%; gelatin content: 3.2%): | coating amount of silver: 0.8 g/m² |
| Hardener (H): | 8 mg/m² |
| (dry thickness: 1 μ) | |

TWELVTH LAYER: SECOND PROTECTIVE LAYER

The same as the Eighth Layer of Sample A (dry thickness: 1 μ).

Sample E was formed into a 35 mm color negative light-sensitive material for cinematography and photographically exposed using a movie camera. Then Sample E was processed according to the following processing steps to provide a cinema color negative.

| Processing Step | Temperature | Time (min) |
|---|---|---|
| Color Development | 38° C | 3 |
| Stop | " | 1 |
| Washing | " | 1 |
| Bleaching | " | 2 |
| Washing | " | 1 |
| Fixing | " | 2 |
| Washing | " | 1 |
| Stabilizing | " | 1 |

The processing solutions used had the following compositions:

| | |
|---|---|
| **Color Developer Solution:** | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Di-sodium Ethylenediamine Tetraacetate (dihydrate) | 2 g |
| 4-Amino-3-methyl-N-ethyl-N-(β-hydroxyethyl)aniline Monosulfate | 4 g |
| Water to make | 1 l |
| **Step Solution:** | |
| Sodium Thiosulfate | 10 g |
| Ammonium Thiosulfate (70% aq. soln.) | 30 ml |
| Acetic Acid | 30 ml |
| Sodium Acetate | 5 g |
| Potassium Alum | 15 g |
| Water to make | 1 l |
| **Bleaching Bath:** | |
| Sodium Ferric Ethylenediamine Tetraacetate (dihydrate) | 100 g |
| Potassium Bromide | 50 g |
| Ammonium Nitrate | 50 g |
| Boric Acid | 5 g |
| Aqueous Ammonia (for adjusting the pH to 5.0) | |
| Water to make | 1 l |
| **Fixing Solution:** | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 l |
| **Stabilizing Bath:** | |
| Boric Acid | 5 g |
| Sodium Citrate | 5 g |
| Sodium Metaborate (tetrahydrate) | 3 g |
| Potassium Alum | 15 g |
| Water to make | 1 l |

The cinema color negative thus obtained from Sample E which is a photographic light-sensitive material according to the present invention was extremely good with respect to color purity, graininess and sharpness.

Similar results can be obtained using Hydroquinone Compound (70), (75), (76), (77) or (79), individually or in combination, in place of Hydroquinone Compound (71) in the Third Layer and the Seventh Layer of Sample E shown in Example 2. Similar results can also be obtained using Coupler (96) to (99) in place of Hydroquinone Compound (71) in the Third Layer or using Coupler (86), (89), (90) or (92) in place of Hydroquinone Compound (71) in the Seventh Layer. Further, similar results can be obtained using Coupler (17), (19), (22), (23), (24), (25), (55), (58) or (63) in place of Coupler (16) in the Fourth Layer and the Ninth Layer. Furthermore, similar results can be obtained using Coupler (1), (7), (8), (10), (11) or (14) in place of Coupler (9) in the Sixth Layer and the Seventh Layer. Also, similar results can be obtained using Coupler (111) or (115) in place of Coupler (109) in the Sixth Layer and the Seventh Layer.

EXAMPLE 3

Figure 3:
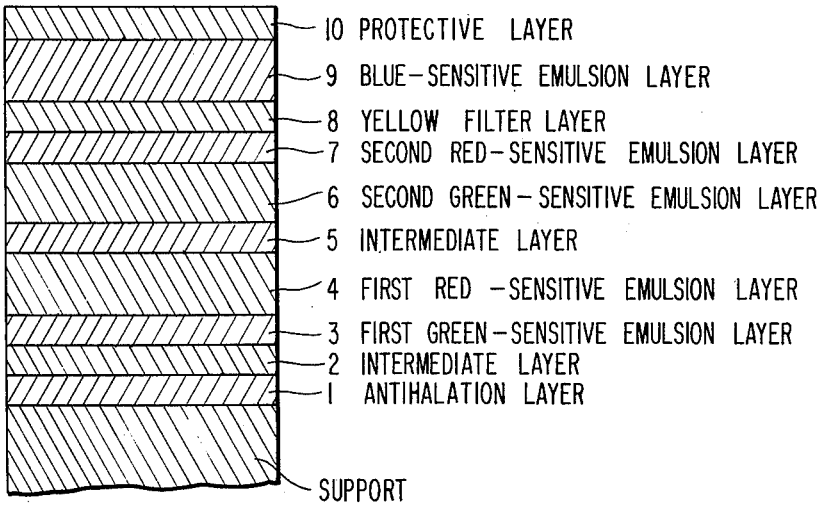

In a manner similar to Example 1, a multilayer color photographic light-sensitive material (Sample F), as illustrated in FIG. 3, was prepared. The compositions of each coating layer were as follows:

FIRST LAYER: ANTIHALATION LAYER

The same as the First Layer of Sample A (dry thickness: 1 μ).

SECOND LAYER: INTERMEDIATE LAYER

The same as the Second Layer of Sample A (dry thickness: 1 μ).

THIRD LAYER: FIRST GREEN-SENSITIVE EMULSION LAYER

Silver iodobromide emulsion (iodide content: 6 mol%;

-continued

| | |
|---|---|
| average grain size: 0.9 μ; silver content: 5.3%; gelatin content: 4.5%): | |
| | coating amount of silver: 0.2 g/m² |
| Sensitizing Dye III: | $2.8 \times 10^{-5}$ mol per mol of silver |
| Sensitizing Dye IV: | $0.9 \times 10^{-5}$ mol per mol of silver |
| Coupler (II): | 0.3 mol per mol of silver |
| Hardener (H): | 9 mg/m² |
| (dry thickness: 1 μ) | |

FOURTH LAYER: FIRST RED-SENSITIVE EMULSION LAYER

| | |
|---|---|
| Silver iodobromide emulsion (iodide content: 7 mol%; average grain size: 0.6 μ; silver content: 5.0%; gelatin content: 5.5%): | |
| | coating amount of silver: 2.5 g/m² |
| Sensitizing Dye I: | $3 \times 10^{-5}$ mol per mol of silver |
| Sensitizing Dye II: | $1.2 \times 10^{-5}$ mol per mol of silver |
| Coupler (116): | 0.07 mol per mol of silver |
| Hydroquinone Compound (75): | |
| | 0.01 mol per mol of silver |
| Hardener (H): | 20 mg/m² |
| (dry thickness: 4 μ) | |

FIFTH LAYER: INTERMEDIATE LAYER

The same as the Second Layer of Sample A (dry thickness: 1 μ).

SIXTH LAYER: SECOND GREEN-SENSITIVE EMULSION LAYER

| | |
|---|---|
| Silver iodobromide emulsion (iodide content: 6 mol%; average grain size: 0.65 μ; silver content: 5.4%; gelatin: 5.1%: | |
| | coating amount of silver: 2.0 g/m² |
| Sensitizing Dye III: | $2.5 \times 10^{-5}$ mol per mol of silver |
| Sensitizing Dye IV: | $0.8 \times 10^{-}$mol per mol of silver |
| Coupler (107): | $4 \times 10^{-2}$ mol per mol of silver |
| Coupler (109): | $2 \times 10^{-2}$ mol per mol of silver |
| Hydroquinone Compound (75): | |
| | $4 \times 10^{-3}$ mol per mol of silver |
| Hardener (H): | 23 mg/m² |
| (dry thickness: 4.5 μ) | |

SEVENTH LAYER: SECOND RED-SENSITIVE EMULSION LAYER

| | |
|---|---|
| Silver iodobromide emulsion (iodide content: 8 mol%; average grain size: 0.9 μ; silver content: 6.1%; gelatin content: 4.2%): | |
| | coating amount of silver: 0.2 g/m² |
| Sensitizing Dye I: | $2.8 \times 10^{-5}$ mol per mol of silver |
| Sensitizing Dye II: | $1 \times 10^{-5}$ mol per mol of silver |
| Coupler (16): | 0.2 mol per mol of silver |
| Hydroquinone Compound (77): | |
| | 0.2 mol per mol of silver |
| Hardener (H): | 8 mg/m² |
| (dry thickness: 1 μ) | |

EIGHTH LAYER: YELLOW FILTER LAYER

The same as the Sixth Layer of Sample A (dry thickness: 1 μ).

NINTH LAYER: BLUE-SENSITIVE EMULSION LAYER

| | |
|---|---|
| Silver iodobromide emulsion (iodide content: 7 mol%; average grain size: 0.7 μ; silver content: 5.4%; gelatin content: 6%):coating amount of silver: 1.5 g/m² | |
| Coupler (100): | 0.1 mol per mol of silver |
| Hydroquinone Compound (75): | |
| | 0.01 mol per mol of silver |
| Hardener (H): | 22 mg/m² |
| (dry thickness: 4 μ) | |

TENTH LAYER: PROTECTIVE LAYER

The same as the Eighth Layer of Sample A (dry thickness: 1 μ).

Sample F was formed into a 16 mm color negative light-sensitive material and photographically exposed using a still camera. Then Sample F was treated in the same manner as described in Example 1 to provide a color negative.

The color negative thus obtained from Sample F which was a photographic light-sensitive material according to the present invention was extremely good with respect to color purity, graininess and sharpness.

A feature in the layer structure of the light-sensitive material of Sample F is that the green-sensitive emulsion layer unit and the red-sensitive emulsion layer unit are divided into two layers, respectively, and these are positioned so that they are separated by an emulsion layer of the other emulsion layer unit. In the photographic material of Sample F, the First Green-Sensitive Emulsion Layer and the Second Red-Sensitive Emulsion Layer in each emulsion layer unit have the function mainly of providing interlayer effects to the other emulsion layer unit, respectively, and contain couplers included within the general formula (I). Also, the Second Green-Sensitive Emulsion Layer and the First Red-Sensitive Emulsion Layer in each emulsion layer unit have the function mainly of forming color images and contain the hydroquinone compounds included within the general formula (II) to provide excellent graininess and sharpness. The multilayer color photographic light-sensitive material of Sample F according to the present invention provides images of superior qualities which could not be achieved using known photographic materials.

From the above-described Examples, methods for practicing the present invention and the features thereof can be understood.

The light-sensitive emulsion layer units illustrated in the Examples can be varied as to their emulsion layers into one, two, three or more, and the order of these emulsion layers can be varied depending on use of the color photographic light-sensitive materials.

The present invention can be applied to conventional color photographic materials such as color negative light-sensitive materials, color reversal light-sensitive materials, color print light-sensitive materials, color transparent positive light-sensitive material, color printing papers, and the like. In addition, the fundamental concept of the present invention can be applied to color X-ray light-sensitive materials, color micro light-sensitive materials, color light-sensitive materials for direct positive use, color light-sensitive materials for the diffusion transfer process, and the like.

While the invention has been described in detail and with reference to specific embodiments thereof, it will be apparent to one skilled in the art that various changes and modifications can be made therein without departing from the spirit and scope thereof.

What is claimed is:

1. A multilayer color photographic light-sensitive material which comprises a support having thereon at least two silver halide emulsion layer units, each of which is sensitive to radiation of a substantially different wavelength region within the wavelength region from about 220 nm to about 800 nm and which contains a color-forming coupler capable of forming a dye on coupling with an oxidized primary aromatic amine developing agent, with at least one of the emulsion layer units containing an ICC coupler represented by the general formula (I)

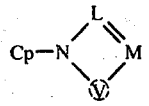

(I)

wherein Cp represents a coupler residue bonded at its coupling position to the N of formula (I); L and M each represents a nitrogen atom or a methine group, and at least one of L and M represents a nitrogen atom; and V represents a monocyclic or dicyclic aromatic ring of the benzene series; which releases a triazole derivative or a diazole derivative on coupling with an oxidized primary aromatic amine developing agent, and with the emulsion layer unit containing the ICC coupler or another layer containing a hydroquinone derivative represented by the general formula (II)

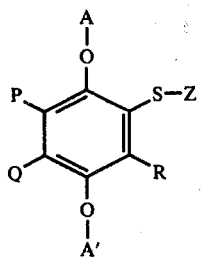

(II)

wherein A and A′ each represents a hydrogen atom or a group capable of being eliminated by an alkali, and A′ can combine with R or Q to form a ring; P, Q or R each represents a hydrogen atom, an alkyl group, an aryl group, an alkylthio group, an arylthio group, a hydroxy group, a halogen atom, an alkoxy group, an aryloxy group, a heterocyclic ring or an —S—Z group, and P and Q can combine to form a ring; and Z represents a heterocyclic ring residue substantially photographically inert in a bonded state; which releases imagewise depending upon development a compound having a mercapto group and/or a coupler which releases a compound having a mercapto group on coupling with an oxidized primary aromatic amine developing agent.

2. The multilayer color photographic light-sensitive material as claimed in claim 1, wherein at least one of said silver halide emulsion layer units comprises at least two silver halide emulsion layers.

3. The multilayer color photographic light-sensitive material as claimed in claim 1, wherein at least one of said silver halide emulsion layer units contains the coupler represented by the general formula (I), and the hydroquinone derivative represented by the general formula (II) and/or the coupler which releases a compound having a mercapto group on coupling with an oxidized primary aromatic amine developing agent.

4. The multilayer color photographic light-sensitive material as claimed in claim 3, wherein said silver halide emulsion layer unit containing said coupler represented by the general formula (I) and the hydroquinone derivative represented by the general formula (II) and/or the coupler which releases a compound having a mercapto group on coupling with an oxidized primary aromatic amine developing agent comprises at least two emulsion layers.

5. The multilayer color photographic light-sensitive material as claimed in claim 4, wherein at least one of the silver halide emulsion layers forming said silver halide emulsion layer unit contains the coupler represented by the general formula (I) and the hydroquinone derivative represented by the general formula (II) and/or the coupler which releases a compound having a mercapto group on coupling with an oxidized primary aromatic amine developing agent.

6. The multilayer color photographic light-sensitive material as claimed in claim 4, wherein at least one of the silver halide emulsion layers forming said silver halide emulsion layer unit contains the coupler represented by the general formula (I) and at least one of the other silver halide emulsion layers forming said silver halide emulsion layer unit contains the hydroquinone derivative represented by the general formula (II) and/or the coupler which releases a compound having a mercapto group on coupling with an oxidized primary aromatic amine developing agent.

7. The multilayer color photographic light-sensitive material as claimed in claim 4, wherein the silver halide emulsion layers forming said silver halide emulsion layer unit are separated from each other by a silver halide emulsion layer of another silver halide emulsion layer unit and/or a layer other than a silver halide emulsion layer.

8. The multilayer color photographic light-sensitive material as claimed in claim 1, wherein the coupler of the general formula (I) is a compound represented by the following general formula (IV)

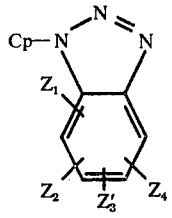

(IV)

wherein Cp has the same meaning as defined for the general formula (I), and $Z_1$ to $Z_4$, which may be the same or different, each represents a hydrogen atom, a halogen atom, an alkyl group, an aryl group, an alkoxy group, an aryloxy group, an acylamido group or a nitro group.

9. The multilayer color photographic light-sensitive material as claimed in claim 1, wherein the coupler which releases a compound having a mercapto group on coupling with an oxidized primary aromatic amine developing agent is compound represented by the following general formula (III)

$$Cp - S - Z \qquad (III)$$

wherein Cp has the same meaning as defined for the general formula (I); and Z has the same meaning as defined for the general formula (II).

10. The multilayer color photographic light-sensitive material as claimed in claim 1, wherein the hydroquinone derivative of the general formula (II) is a compound in which Z is a group represented by the following general formula (V)

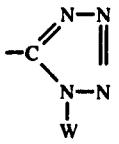

(V)

wherein W represents an aryl group, an alkyl group or a heterocyclic group.

11. The multilayer color photographic light-sensitive material as claimed in claim 9, wherein the coupler which releases a compound having a mercapto group on coupling with an oxidized primary aromatic amine developing agents is a compound in which Z is a group represented by the general formula (V)

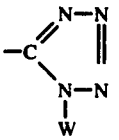

(V)

wherein W represents an aryl group, an alkyl group or a heterocylcic group.

12. The multilayer color photographic light-sensitive material as claimed in claim 1, wherein said photographic material contains at least one coupler represented by the general formula (I) and at least one hydroquinone derivative represented by general formula (II).

13. The multilayer color photographic light-sensitive material as claimed in claim 1, wherein said photographic material contains at least one coupler represented by the general formula (I) and at least one coupler which releases a compound having a mercapto group on coupling with an oxidized primary aromatic amine developing agent.

14. The multilayer color photographic light-sensitive material as claimed in claim 1, wherein said photographic material contains at least one coupler represented by the general formula (I), at least one coupler which releases a compound having a mercapto group on coupling with an oxidized primary aromatic amine developing agent, and at least one hydroquinone derivative represented by the general formula (II).

* * * * *

UNITED STATES PATENT AND TRADEMARK OFFICE

CERTIFICATE OF CORRECTION

PATENT NO. : 4,015,988

DATED : April 5, 1977

INVENTOR(S) : Shiba et al.

It is certified that error appears in the above-identified patent and that said Letters Patent is hereby corrected as shown below:

Abstract, 2nd column, line 3: The symbol (V) should be changed to-- (V) --; line 23: The words "R to Q to" should be changed to--R or Q to--.

Column 1, line 23: The words "form a color" should be changed to--form a magenta color--.

Column 16, line 1: The expression "5 or 6-benzotriazolyl" should be changed to--5 or 6-bromo-1-benzotriazolyl--; line 2: The expression "acetanilide 17. α-Benzoyl" should be changed to start a new paragraph as follows:

--acetanilide
17. α-Benzoyl--;

line 45: The expression "2-benzothiazolidenyl)amino" should be changed to--2-benzothiazoliden)imino--; line 47: The expression "2-benzothiazolidenyl)amino" should be changed to--2-benzothiazoliden)imino--; lines 49 and 52: The expression "amino" should be changed to--imino--.

Column 17, lines 6, 9 and 13: The expression "amino" should be changed to--imino--; line 15: The expression "5 or 6-benzotriazolyl" should be changed to--5 or 6-benzyloxy-1-benzotriazolyl--; line 25: The expression "isopropylbenzoyloxy" should be changed to--isopropylbenzyloxy--; lines 28 and 58: The expression "amino" should be changed to--imino--; line 62: The expression "naphthamide 65. 1-Hydroxy" should be changed to start a new paragraph as follows:

--naphthamide
65. 1-Hydroxy--;

line 65: The expression "5-benzoyloxy" should be changed to--5-benzyloxy--.

UNITED STATES PATENT AND TRADEMARK OFFICE

CERTIFICATE OF CORRECTION

PATENT NO. : 4,015,988

DATED : April 5, 1977

INVENTOR(S) : Shiba et al.

It is certified that error appears in the above-identified patent and that said Letters Patent is hereby corrected as shown below:

Column 18, line 23: The expression "hydroquinone 77. 2-[2',5'-Dihydroxy-6'" should be changed to start a new paragraph as follows:

--hydroquinone
77. 2-[2',5'-Dihydroxy-6'--;

line 23: The expression "6'-methoxyacetanilide 1"-phenyl" should be changed to--6'-(1"-phenyl--; line 38: The expression "2-benzothiazolythio" should be changed to--2-benzothiazolylthio--; line 55: The expression "pyrazolone 89. 1-[α-(2,4-Di" should be changed to start a new paragraph as follows:

--pyrazolone
89. 1-[α-(2,4-Di- --.

Column 19, line 6: The expression "-N-[-(2,4-" should be changed to-- -N-[α-(2,4- --; line 15: The expression "5-chlorophenol" should be changed to--6-chlorophenol--; line 66: The expression "methoxyacetamilide" should be changed to--methoxyacetanilide--.

Column 21, line 15: The number "2,560,212" should be changed to--3,560,212--; line 21: The words "group of a sulfo" should be changed to--group or a sulfo--; line 35: The words "method for dispersing" should be changed to--method of dispersing--.

Column 22, line 60: The number "3,493,748" should be changed to--2,493,748--.

Column 23, line 54: The expression "U.s. Pat." should be changed to--U.S. Pat.--.

UNITED STATES PATENT AND TRADEMARK OFFICE

CERTIFICATE OF CORRECTION

PATENT NO. : 4,015,988

DATED : April 5, 1977

INVENTOR(S) : Shiba et al.

It is certified that error appears in the above-identified patent and that said Letters Patent is hereby corrected as shown below:

Column 24, line 37: The word "presursors" should be changed to--precursors--.

Column 31, line 8: The expression "9 $mg/m^2$" should be changed to--8 $mg/m^2$--.

Signed and Sealed this

Seventh Day of June, 1988

*Attest:*

DONALD J. QUIGG

*Attesting Officer*

*Commissioner of Patents and Trademarks*